US006433765B1

(12) United States Patent
Fujiwara et al.

(10) Patent No.: US 6,433,765 B1
(45) Date of Patent: Aug. 13, 2002

(54) LIQUID CRYSTAL DISPLAY

(75) Inventors: Kouji Fujiwara, Tenri; Tomohiko Yamamoto, Nara; Keiichi Tanaka, Tenri; Naoto Inoue, Shiki-gun; Hideki Ichioka; Hisao Okada, both of Ikoma-gun, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 176 days.

(21) Appl. No.: 09/580,500

(22) Filed: May 30, 2000

(30) Foreign Application Priority Data

Jun. 2, 1999 (JP) ..... 11-155663
Mar. 29, 2000 (JP) ..... 2000-092375

(51) Int. Cl.[7] ..... G09G 3/36

(52) U.S. Cl. ..... 345/87; 345/204; 345/205; 345/90; 345/98; 345/100; 349/43; 349/139

(58) Field of Search ..... 345/87, 90, 92–95, 345/98, 100, 204, 205, 55, 58, 104; 349/41–43, 123, 128–130, 139, 141, 148, 149, 151, 152

(56) References Cited

U.S. PATENT DOCUMENTS 4,678,282 A 7/1987 Yaniv et al.
4,694,287 A 9/1987 Chenevas-Paule et al.
5,504,348 A * 4/1996 Yoshida et al. ..... 257/363
5,537,129 A * 7/1996 Okada et al. ..... 345/90
5,737,041 A * 4/1998 Holmberg et al. ..... 205/124
5,818,402 A * 10/1998 Park et al. ..... 345/100
5,831,605 A * 11/1998 Yasui et al. ..... 345/204
5,978,058 A * 11/1999 Sung ..... 349/139
6,011,532 A * 1/2000 Yanai et al. ..... 345/206
6,115,099 A * 9/2000 Yamamoto et al. ..... 349/177
6,222,516 B1 * 4/2001 Oda et al. ..... 345/100

FOREIGN PATENT DOCUMENTS

JP 3-72321 A 3/1991
JP 4-191821 A 7/1992
JP 5-181151 7/1993
JP 7-128687 5/1995

OTHER PUBLICATIONS

U.S. Patent Application Ser. No. 09/298,161, filed Apr. 23, 1999, entitled: "Liquid Crystal Display Device and Method for Producing the Same".

* cited by examiner

*Primary Examiner*—Richard Hjerpe
*Assistant Examiner*—Henry N. Tran
(74) *Attorney, Agent, or Firm*—Nixon & Vanderhye, P.C.

(57) ABSTRACT

A liquid crystal display in which a reference signal main line, placed so as to connect reference signal lines to each other, is separated into an input main line and an output main line in an insulating state from each other. Then, a voltage application line from a voltage-application circuit for controlling the voltage of a reference signal is connected to the input main line and a voltage feedback line therefrom is connected to the output main line. Thus, it becomes possible to accurately detect minute voltage variations within a reference signal circuit and compensate for them.

8 Claims, 24 Drawing Sheets

LIQUID CRYSTAL DISPLAY

FIELD OF THE INVENTION

The present invention relates to a liquid crystal display, and more particularly concerns an active-matrix driving-type liquid crystal display that is preferably used in the field of flat panel displays.

BACKGROUND OF THE INVENTION

Conventionally, liquid crystal displays using a nematic liquid crystal have been widely used in watches, calculators and other articles as segment-type liquid crystal displays. In recent years, thanks to their features such as thinness, light-weight and low power consumption, the liquid crystal displays of this type have been used as various displays for word processors, personal computers and navigation systems, and have rapidly broaden their markets. In particular, much attention has been focused on liquid crystal displays of the active-matrix type in which active elements such as TFTs (Thin Film Transistors) are used as switching elements, with pixels arranged in a matrix format.

There have been ever-increasing demands for the liquid crystal displays of this type in wider fields including displays of note-type or desktop-type personal computers, portable televisions and space-saving televisions, and displays of digital cameras and digital video cameras, because they have advantages, such as a great reduction in thickness (depth), easiness for providing full-color devices and smaller power consumption, as compared with, for example, CRTs (Cathode Ray Tube).

A conventional active-matrix-type liquid crystal display of the light-transmission type is constituted by a light-transmitting active-matrix substrate on which an active-matrix circuit consisting of TFTs is formed, an opposing substrate having common electrodes formed thereon that is aligned face to face with the active-matrix substrate, and a liquid crystal layer that is interpolated between the active-matrix substrate and the opposing substrate.

FIG. 23 is a circuit diagram that schematically shows one example of the active-matrix circuit on the active-matrix substrate. A plurality of pixel electrodes 91 are formed on the active-matrix substrate in a matrix format. Normally, the pixel electrodes 91 are arranged in the row direction and column direction, with several hundreds pixels being aligned in each direction.

Moreover, common electrodes (not shown) are formed on the opposing substrate, not shown, in a manner so as to face the pixel electrodes 91 through the liquid crystal layer, and a voltage is applied to the liquid crystal layer by the pixel electrodes 91 and the common electrodes. Here, in general, the common electrodes are formed virtually on the entire surface of the opposing substrate.

Furthermore, TFTs 92, which are active elements serving as switching means for selectively driving the pixel electrodes 91, are formed on the active-matrix substrate, and connected to the pixel electrodes 91. In order to provide color display, color filter layers (not shown) of red, green, blue, etc. are formed on the opposing substrate, the active-matrix substrate or another member.

Scanning lines 93 are connected to the gate electrodes of the TFTs 92, and gradation signal lines 94 are also connected to the source electrodes of the TFTs 92. The scanning lines 93 and the gradation signal lines 94 are allowed to pass around the pixel electrodes 91 arranged in the matrix format, and placed so as to intersect each other. Gate signals are inputted through the scanning lines 93 so that the TFTs 92 are controlled and driven. Moreover, at the time of driving the TFTs 92, data signals are inputted to the pixel electrodes 91 through the gradation signal lines 94. Here, scanning signal input terminals 93*a* are connected to ends of the scanning lines 93, and data signal input terminals 94*a* are connected to ends of the gradation signal lines 94.

Moreover, the drain electrodes of the TFTs 92 are connected to the pixel electrodes 91, and also connected to added capacitances 95. Then, each electrode on the opposing side of the added capacitance 95 with respect to the insulating layer is connected to each of common electrodes 96. The added capacitance 95 is used for holding a voltage that is applied to the liquid crystal layer.

In the active-matrix-type liquid crystal display, the liquid crystal layer sandwiched between the active-matrix substrate and the opposing substrate is normally set to have an average thickness of 3.0 to 4.5 $\mu$m; thus, a liquid crystal capacitance is formed by the pixel electrodes 91, the common electrodes and the liquid crystal layer. Here, the added capacitances 95 are connected in parallel with the liquid crystal capacitance.

In the active-matrix-type liquid crystal display having the above-mentioned arrangement, however, the scanning lines 93 and the gradation signal lines 94 are arranged to intersect each other on the same substrate, and these large number of intersections are highly susceptible to short-circuiting and the resulting defects. This has caused a reduction in the yield and high costs.

In order to solve the problem with such a construction having intersecting scanning lines and gradation signal lines on the same substrate, a liquid crystal display, for example, as shown in FIG. 24, has been proposed. This liquid crystal display has a construction explained as follows:

A number of switching elements 101 with three terminals, constituted by amorphous silicon semiconductors, are installed on one of substrates 100 in a matrix format. Here, a scanning line 102 is connected to one terminal of the switching element 101 for each line, and a reference signal line 103 is connected to another terminal of the switching element 101 for each line. Moreover, a pixel electrode 104 is connected to the other terminal of each of the switching elements 101.

A plurality of gradation signal lines 106 are placed in a direction orthogonal to the scanning lines 102 on an opposing substrate 105 that is placed in a manner so as to face the substrate 100. The gradation signal lines 106 also function as opposing electrodes at portions facing pixel electrodes 104.

In this arrangement, the scanning lines and the gradation signal lines are not made to intersect each other on the same substrate, and placed on respectively different substrates; therefore, it is possible to reduce the rate of occurrence of line defects. Thus, it becomes possible to improve the yield and also to reduce costs. Additionally, hereinafter, the construction of a liquid crystal display shown in FIG. 23 is referred to as the present construction, and the construction of a liquid crystal display shown in FIG. 24 is referred to as "opposing source construction".

As described above, there have been ever-increasing demands for large-size panels and high-precision devices with respect to liquid crystal displays. One of the major problems with the achievement of the large-size panels and high-precision devices is degradation in the display quality due to signal delays. Here, the signal delays refer to signal delays in the common signal line in the case of the present construction, and also refer to signal delay in the reference signal line in the opposing source construction.

As the panel size increases, the signal wire becomes longer, thereby increasing the resistivity of the signal wire itself and the parasitic capacitance imposed on the signal wire. Since the size of the signal delay is in proportion to a product of the resistivity of the signal wire and the load capacitance, the enlargement of the panel size, which increases both the resistivity of the signal wire and the load capacitance, causes a great signal delay. Consequently, in a certain area inside the display area in the liquid crystal display, there might be a failure in which a desired voltage is not applied to the liquid crystal within a writing period, resulting in a state in which the liquid crystal is not sufficiently charged, that is, an insufficient charge-supply state. This state causes so-called shadowing, resulting in degradation in the display quality.

Referring to FIG. 19, the following description will discuss the shadowing. For example, as illustrated in FIG. 19, suppose that an image pattern (hereinafter, referred to as a shadowing pattern) is displayed so that only the area 31 in the center has a black display with the other areas having half-tone displays. Here, in FIG. 19, the area on the right side of the center area 31 is referred to as area 32, the area on the left side of the center area 31 is referred to as area 33, the areas above areas 31, 32 and 33 are referred to as area 34, and the areas below areas 31, 32 and 33 are referred to as area 35.

In the case of a normally white display, the black display has a greater liquid crystal capacitance than the white display. In other words, in the display state of this type, the load capacitance of a lateral signal wire contained in the areas 31, 32 and 33, that is, a lateral wire connected to the pixels that carry out a black display, is greater than the load capacitance of a signal wire contained in areas 34 and 35 due to the influence of area 31 having a black display. In other words, the signal delay in the lateral signal wire connected to the pixels that carry out a black display is greater in such a manner that depending on cases, there is a difference between the applied voltage to the liquid crystal at areas 32, 33 and the applied voltage to the liquid crystal at areas 34, 35. Consequently, in the areas located on both sides of the black display area, a desired voltage is not applied to the liquid crystal due to the signal delay, with the result that an insufficient charge occurs and these areas have a display different from that of the other halftone areas. This is a phenomenon referred to as the shadowing due to signal delay.

The above-mentioned description has discussed a problem with the enlargement of the panel size in the liquid crystal display, and a similar problem arises with an attempt to achieve the high precision. In other words, the high-precision apparatus makes the writing time of the signal shorter, and consequently becomes more susceptible to influences of a signal delay, thereby resulting in degradation in the display quality in the same manner as described above.

As described above, as an attempt is made so as to achieve the large-size panel and high precision in a liquid crystal display, problems arise from an increase in the resistivity of each signal wire, an increase in the load capacitance to each signal wire, a reduction in the writing time of the signal, etc., thereby causing a signal delay and the resulting degradation in the display quality such as the shadowing.

In order to reduce the signal delay as described above, and to eliminate an insufficient charge supply to the liquid crystal, effective methods are to reduce the resistivity of the signal wire and to minimize the load capacitance to the signal wire. More specifically, (1) in order to reduce the resistivity of the signal wire, a metal film forming the signal wire is made thicker, (2) in order to reduce the resistivity of the signal wire, the line width of the signal wire is made thicker, and (3) in order to minimize the load capacitance to the signal wire, the distance between the signal wires is widened. These arrangements make it possible to reduce the signal delay.

However, in the above-mentioned arrangement (1), since the metal film needs to be stacked thicker, the film-forming time of the metal film is prolonged, resulting in degradation in the productivity. Moreover, a difficult controlling process is required upon etching the metal film into a predetermined pattern, resulting in a reduction in the rate of non-defective products and high costs.

In the above-mentioned arrangements (2) and (3), the thickened signal wire or the widened distance between the signal wires causes a reduction in areas to be used as pixels, resulting in a reduction in the aperture ratio. The decreased aperture ratio decreases the transmittance and luminance of the liquid crystal display, resulting in degradation in the display quality.

As described above, the above-mentioned arrangements (1) to (3) tend to raise problems of a reduction in the rate of non-defective products and a decrease in the aperture ratio, resulting in high costs and degradation in the display quality.

Moreover, another arrangement may be proposed in which signals are inputted from both sides of the panel, that is, from both sides of each signal wire, so that it is possible to decrease the signal delay and also to compensate for the insufficient supply of charge. However, in order to input signals from both sides of the panel, it is necessary to install drivers for inputting signals on both sides of the panel. In other words, the number of drivers is doubled, resulting in a problem of very high costs.

Furthermore, with respect to the means for reducing the shadowing caused by the signal delay without modifying the design of the inside of the panel, a method for applying a voltage to each pixel by using a dot-inversion driving system. Here, an explanation will be given of the dot-inversion driving system and the line-inversion driving system.

First, referring to FIG. 23 and FIGS. 21(*a*) and 21(*b*), an explanation will be given of the line-inversion driving system. In the case when, as shown in FIG. 23, a signal is inputted to a certain scanning line 93 in such a manner that all the TFTs 92 connected to the scanning line 93 are turned on, supposing that a displayed image is a solid image, voltage signals having the same polarity are applied to all the adjacent gradation signal lines 94. In other words, all the voltages to be applied to the pixel electrodes 91 connected to the scanning line 93 have the same polarity.

When, upon completion of the scanning process for one line, such a signal as to turn all the TFTs 92 on is inputted to the next scanning line 93, applied voltage signals having a polarity reversed to that at the time of the previous scanning process preceded by one line are inputted to all the gradation signal lines 94. In other words, at this time, all the voltages to be applied to the pixel electrodes 91 connected to the scanning line 93 have the same polarity, with the polarity being reversed to that at the time of the previous scanning process preceded by one line.

FIG. 21(*a*) shows part of the state of the voltage polarity applied to each pixel at the time when the above-mentioned scanning process is repeated. When, after completion of the scanning process for one screen, a scanning process for the next screen is carried out, voltages having a polarity reversed to that at the time of the scanning process of the previous screen is applied to the pixel electrodes 91 for each line. FIG. 21(*b*) shows this state. More specifically, in the case when the line inversion driving is carried out, refreshing of the screen is carried out by repeating the state of FIG. 21(*a*) and the state of FIG. 21(*b*).

Next, referring to FIG. 23 and FIGS. 22(*a*) and 22(*b*), an explanation will be given of the dot-inversion driving system. In the case when, as shown in FIG. 23, a signal is inputted to a certain scanning line 93 in such a manner that all the TFTs 92 connected to the scanning line 93 are turned on, supposing that a displayed image is a solid image, applied voltage signals having respectively different polarities are inputted to the adjacent gradation signal lines 94. In other words, the voltages to be applied to the adjacent pixel electrodes 91 connected to the scanning line 93 have the respectively reversed polarities.

When, upon completion of the scanning process for the one line in question, such a signal as to turn all the TFTs 92 on is inputted to the next scanning line 93, applied voltage signals having a polarity reversed to that at the time of the previous scanning process preceded by one line are inputted to all the gradation signal lines 94. In other words, at this time, the voltages to be applied to the adjacent pixel electrodes 91 connected to the scanning line 93 have the respectively reversed polarities, with each polarity being reversed to that at the time of the previous scanning process preceded by one line.

FIG. 22(*a*) shows part of the state of the voltage polarity applied to each pixel at the time when the above-mentioned scanning process is repeated. When, after completion of the scanning process for one screen, a scanning process for the next screen is carried out, voltages having a polarity reversed to that at the time of the scanning process of the previous screen is applied to the pixel electrodes 91 for each line. FIG. 22(*b*) shows this state. More specifically, in the case when the line inversion driving is carried out, refreshing of the screen is carried out by repeating the state of FIG. 22(*a*) and the state of FIG. 22(*b*).

In the case of the line inversion driving system, when the shadowing pattern as shown in FIG. 19 is displayed, it is necessary for the common signal line 96 which is connected to the scanning electrode 93 to which the signal for turning the TFTs 92 on is inputted and the corresponding opposing electrodes to apply or remove a charge having the same polarity to or from all the pixel electrodes 91 connected to the scanning line 93. Therefore, this system is highly susceptible to an insufficient charge supply due to the signal delay, causing the generation of shadowing.

In contrast, in the case of the dot inversion driving system, voltages that are applied to the pixel electrodes 91 connected to one scanning line 93 have respectively reversed polarities with respect to the adjacent pixel electrodes 91; therefore, it is not necessary for the common signal line 96 to apply or remove a great charge. Therefore, this system is less susceptible to an insufficient charge supply due to the signal delay and the resulting shadowing.

Therefore, as described above, with respect to the method for reducing the shadowing caused by the signal delay, it is more effective to use a method for applying a voltage to each pixel by the dot inversion driving system.

However, the dot inversion driving system has the following limitations: a source driver capable of outputting a doubled voltage is required so as to allow the gradation voltages of the adjacent pixels to be amplified reversely to each other, and the common signal line 96 and the opposing electrode simultaneously form references for a plus charge and a minus charge so that it is possible to output a signal line voltage two times as much as that at the time of line inversion driving process. This causes other limitations such as the necessity of a source driver having a higher voltage resistant property. As a result, this driving system causes an increase in the cost of a source driver as compared with the line inversion driving system.

Here, as described above, in the above-mentioned opposing source construction, since the scanning lines and the gradation signal lines are formed on individually different substrates without intersecting each other on the same substrate; therefore, the rate of occurrence of line defects is reduced so that the yield is improved and the cost is decreased. Moreover, since no signal wires intersect each other on the same substrate, it is possible to reduce the capacitance imposed on the signal wires, and consequently to reduce the signal delay. However, as an attempt is further made to achieve large-size liquid crystal panels with higher precision, it becomes more difficult to produce them without causing degradation in the display quality and an increase in the costs.

Here, an explanation will be given of the fact that as compared with the current construction, the opposing source construction causes more problems in achieving large-size liquid crystal panels and higher precision. As shown in FIG. 23, in the current construction, the flow of image signals based upon image data is described as follows: The image signal is allowed to reach one of the pixel electrodes 91 from the gradation signal line 94 through the TFT 92 so that a voltage is applied to the liquid crystal between the pixel electrode 91 and the opposing electrode.

In contrast, in the opposing source construction as shown in FIG. 24, when an image signal is inputted to the gradation signal line 106, a current flows to the pixel electrode 104 from the reference signal line 103 through the TFT 101 so that a voltage is applied to the liquid crystal.

As described above, in the current construction, the output of the source driver connected to the respective gradation signal lines 94 and the reference voltage in the opposing electrode is used so as to apply a voltage to the liquid crystal. In contrast, in the opposing source construction, the output of the source driver connected to the respective gradation signal lines 106 and the reference voltage in the reference signal line 103 is used so as to apply a voltage to the liquid crystal.

In the current construction, it is the opposing electrode to which the reference voltage is inputted. This opposing electrode is generally formed by a transparent conductive film having a thickness of 1500 to 4500 Å, and its width is set to approximately the same as the width of each pixel area. In other words, with respect to the opposing electrode, since its width is made comparatively wider so that the resistance is made comparatively smaller. In contrast, in the opposing source construction, it is the reference signal line 103 to which the reference voltage is inputted. Since this reference signal line 103 is formed by an opaque metal thin film, it is necessary to make its width as thin as possible so as not to cause a reduction in the aperture ratio in the liquid crystal panel. Therefore, the reference signal line 103 has a comparatively high resistivity. Consequently, as compared with the current construction, the opposing source construction tends to cause an insufficient supply of charge due to a signal delay in the reference signal line 103, resulting in large shadowing.

SUMMARY OF THE INVENTION

The objective of the present invention is to prevent shadowing in a liquid crystal display having an opposing source construction by eliminating an insufficient supply of charge to the liquid crystal due to a delay in the reference signal while maintaining the advantages of the opposing source construction, and consequently to provide a large-size liquid crystal display with high precision that is superior in display quality.

In order to achieve the above-mentioned objective, the liquid crystal display of the present invention, which comprises:

a pixel substrate;

an opposing substrate aligned face to face with the pixel substrate with a gap in between;

a liquid crystal layer that is sandwiched in the gap between the pixel substrate and the opposing substrate;

a plurality of pixel electrodes formed on the pixel substrate in a matrix format;

opposing electrodes formed on the opposing substrate in association with the pixel electrodes;

a plurality of scanning lines and a plurality of reference signal lines that are placed in parallel with each other in each of the border areas between the pixel electrodes on the pixel substrate;

a gradation signal line that is placed in a direction orthogonal to the scanning lines on the opposing substrate and that is electrically connected to the opposing electrodes; and a switching element of a three-terminal type having respective terminals electrically connected to the scanning line, the reference signal line and the pixel electrode on the pixel substrate, is characterized by further comprising:

a reference signal main line that is placed so as to electrically connect the reference signal lines with each other on the periphery of the area in which the reference signal lines are placed; and a voltage applying circuit for applying a reference signal voltage to a reference signal circuit constituted by the reference signal lines and the reference signal main line, and for controlling the applying voltage in response to voltage variations in the reference signal circuit, wherein: the reference signal main line includes an input main line and an output main line, the input main line and the output main line being electrically connected to each other through the reference signal line, with their portions other than the connected portions through the reference signal line being in an electrically insulated state or in a high impedance state, and an input section for applying a voltage from the voltage applying circuit is placed in the input main line and an output section for feeding a voltage back to the voltage applying circuit is placed in the output main line.

In the above-mentioned arrangement, the input main line and the output main line are placed as the reference signal main line, the input main line and the output main line are electrically connected through the reference signal line, with their portions other than the connected portions through the reference signal line being in an electrically insulated state or in a high impedance state, and an input section for applying a voltage from the voltage applying circuit is placed in the input main line and an output section for feeding a voltage back to the voltage applying circuit is placed in the output main line; therefore, a voltage applied to the reference signal circuit through the input section is outputted from the output section after passing through the reference signal line. Consequently, the voltage applying circuit is allowed to accurately detect minute voltage variations caused by the respective reference signal lines inside the reference signal circuit, and can carry out a proper voltage-compensating process by adjusting the applying voltage based upon the detected voltage variations. With this arrangement, without a reduction in the aperture ratio caused by the widened line width of the reference signal line and the widened distance between the line gaps, it is possible to prevent shadowing caused by an insufficient supply of charge due to a delay in the reference signal, and consequently to provide a liquid crystal display that is superior in display quality.

Moreover, in the above-mentioned arrangement, the liquid crystal display has the so-called opposing source construction so that the scanning lines and the gradation signal lines are formed on independently different substrates; therefore, since the scanning lines and the gradation signal lines are not made to intersect each other on the same substrate, it is possible to reduce the rate of occurrence of line defects. Consequently, it becomes possible to improve the yield and also to reduce the production costs.

Here, "the state having a high impedance" refers to a state having an impedance sufficiently greater than the impedance within a panel so as to allow accurate detection of voltage variations inside the panel.

For a fuller understanding of the nature and advantages of the invention, reference should be made to the ensuing detailed description taken in conjunction with the accompanying drawings.

BRIEF DESCRIPTION OF THE DRAWINGS

FIG. 10 is viewed from above.

FIG. 14(*b*) is a plan view showing an arrangement in which an input main line and an output main line are respectively divided into three blocks.

DESCRIPTION OF THE EMBODIMENTS

Referring to Figures, the following description will discuss one embodiment of the present invention.

Figure 2:
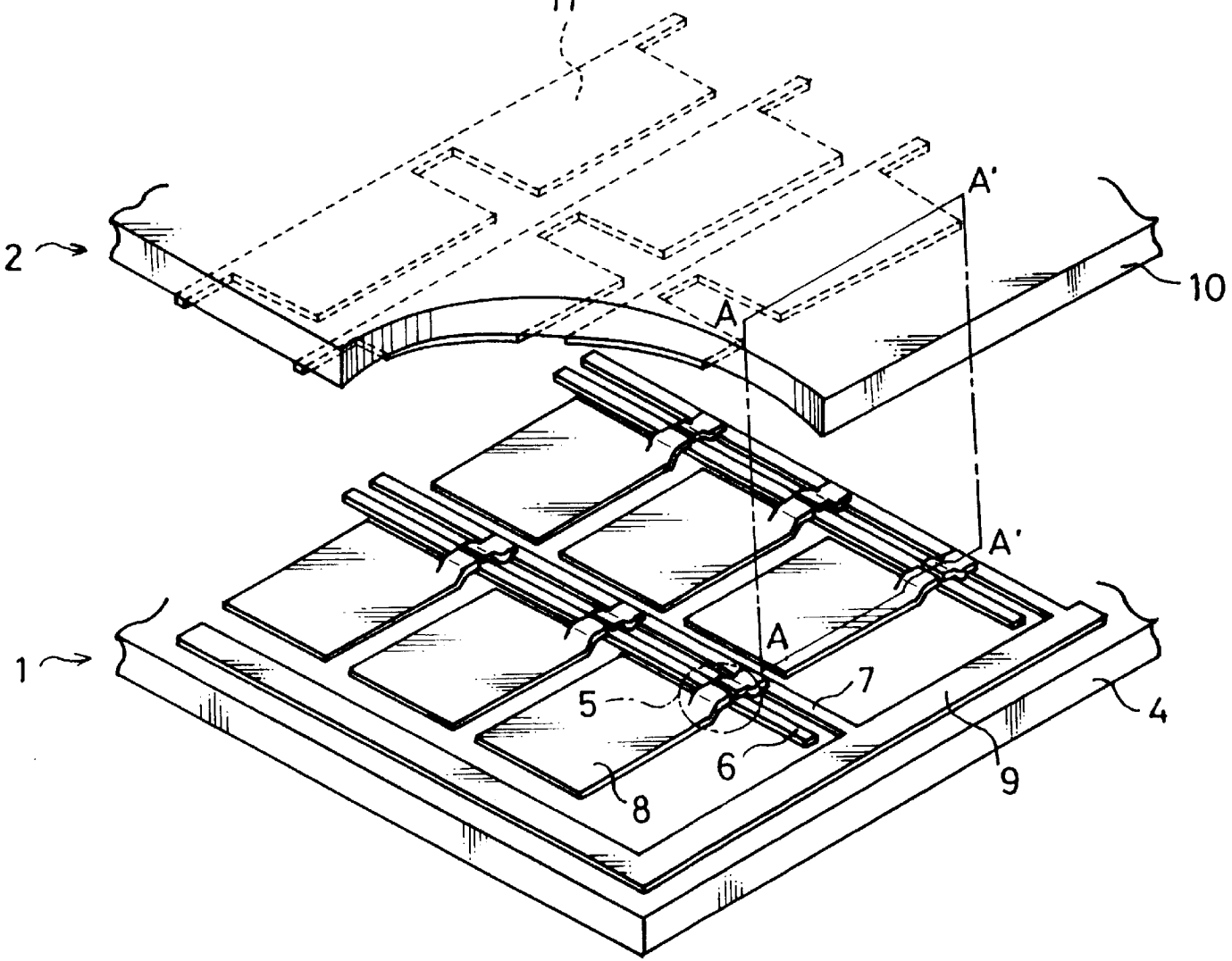
FIG. 2 is a perspective view that shows a schematic construction of one portion of the liquid crystal display.
Figure 3:
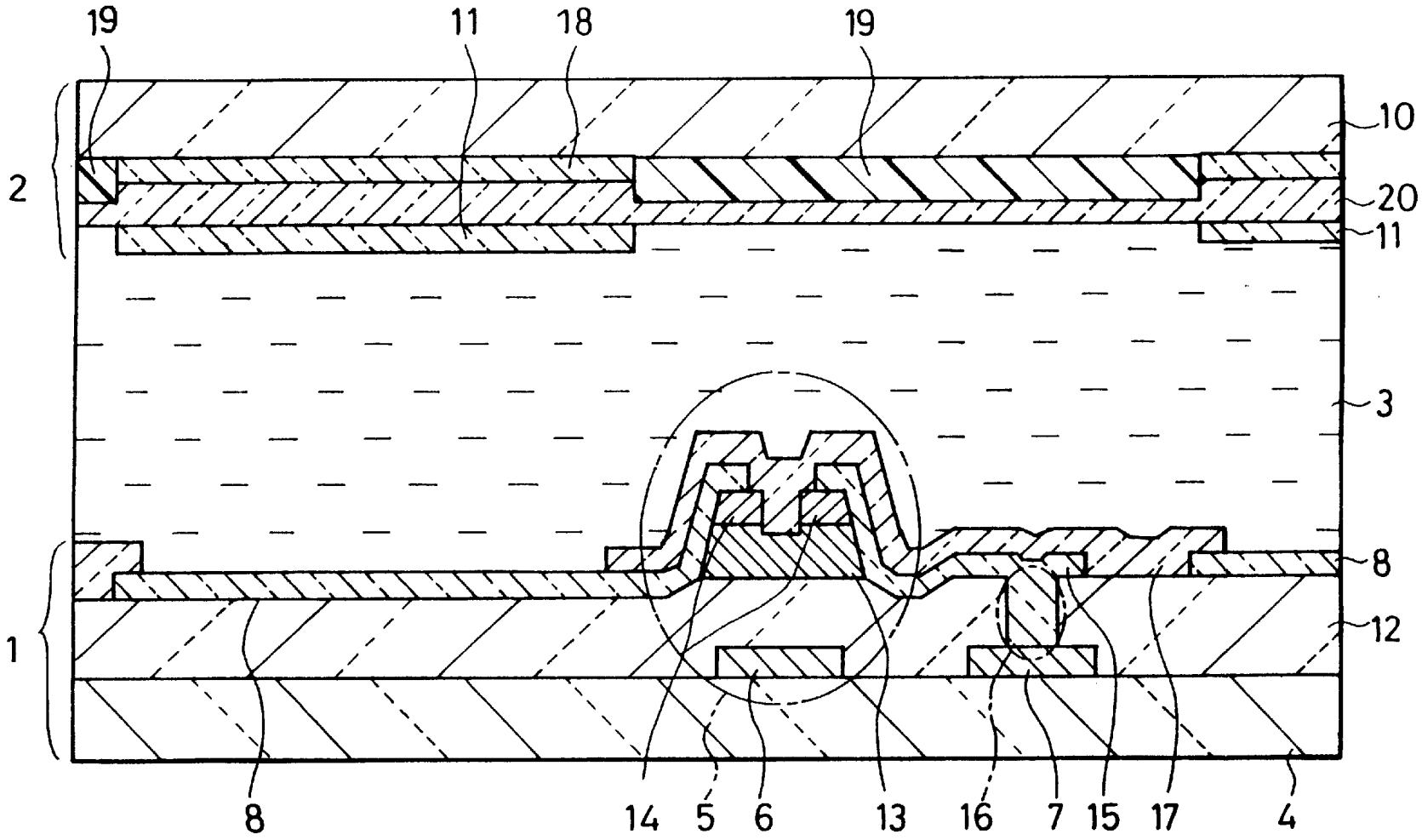
FIG. 3 is a cross-sectional view taken along line A—A' of FIG. 2.

FIG. 2 is a perspective view that shows a schematic construction of one portion of the liquid crystal display, and FIG. 3 is a cross-sectional view taken along line A—A' of FIG. 2. The liquid crystal display is provided with: a pixel substrate 1, an opposing substrate 2 placed with a predetermined gap to the pixel substrate 1, and a liquid crystal layer 3 that is sandwiched in the gap between the pixel substrate 1 and the opposing substrate 2.

The pixel substrate 1 has an arrangement in which: on an insulating transparent substrate 4 are formed switching elements 5 that are constituted by amorphous silicon semiconductors, etc. and placed in a matrix format, scanning lines 6 connected to one terminal of the switching elements 5 for respective rows, reference signal lines 7 connected to another terminal of the switching elements 5 for respective rows, and pixel electrodes 8 connected to still another terminal of the respective switching elements 5. Moreover, a reference signal main line 9 is installed on the peripheral portion of the pixel substrate 1, and each reference signal line 7 is connected to the reference signal main line 9 at both ends thereof.

The opposing substrate 2, aligned face to face with the pixel substrate 1, has an arrangement in which gradation signal lines 11 are formed on an insulating transparent substrate 10 in a direction orthogonal to the scanning lines 6. These gradation signal lines 11 are also allowed to serve as opposing electrodes at portions thereof opposing to the pixel electrodes 8.

Next, referring to FIG. 3,. an explanation will be given of a sequence of manufacturing processes of the pixel substrate 1. First, for example, Ta is stacked on the insulating transparent substrate 4 with a thickness of approximately 3000 Å by using a sputtering method, etc., and this is patterned so that the scanning lines 6 and the reference signal lines 7 are formed.

Next, for example, SiNx is stacked with a thickness of 2000 to 4000 Å by using a plasma CVD (Chemical Vapor Deposition) method so that a gate insulating film 12 is formed. Successively, by using a plasma CVD method, an a-Si layer 13 and an n+a-Si film 12 are stacked as channel layers with a thickness of approximately 1500 Å and a thickness of approximately 400 Å respectively.

After the channel sections have been patterned, a hole section 16 is formed in the gate insulating film 12 by etching, and a transparent conductive film, made of ITO (Indium Tin Oxide), etc., is then stacked by sputtering, etc. with a thickness of approximately 1000 to 1500 Å. Then, this transparent conductive film is patterned so that the pixel electrodes 8 and wires 15 which connect the switching elements 5 and the reference signal lines 7 through the hole section 16 are formed. Moreover, for example, SiNx is stacked by a plasma CVD method with a thickness of approximately 2000 Å, and this is patterned so that a protective film 17 is formed.

Next, referring again to FIG. 3, an explanation will be given of a sequence of manufacturing processes of the opposing substrate 2. First, a color filter layer 18 and a black matrix layer 19 are formed on the surface of the insulating transparent substrate 10 on the pixel substrate 1 side, and an over-coat layer 20, which is a flattening layer, is further formed on the surfaces of the color filter layer 18 and the black matrix layer 19 on the pixel substrate 1 side. Moreover, a plurality of gradation signal lines 11 are formed in a direction orthogonal to the scanning lines 6 on the surface of the over-coat layer 20 on the pixel substrate 1 side, and these are patterned so that the opposing electrode sections and wiring sections between the opposing electrodes are formed by a patterning process.

Figure 4:
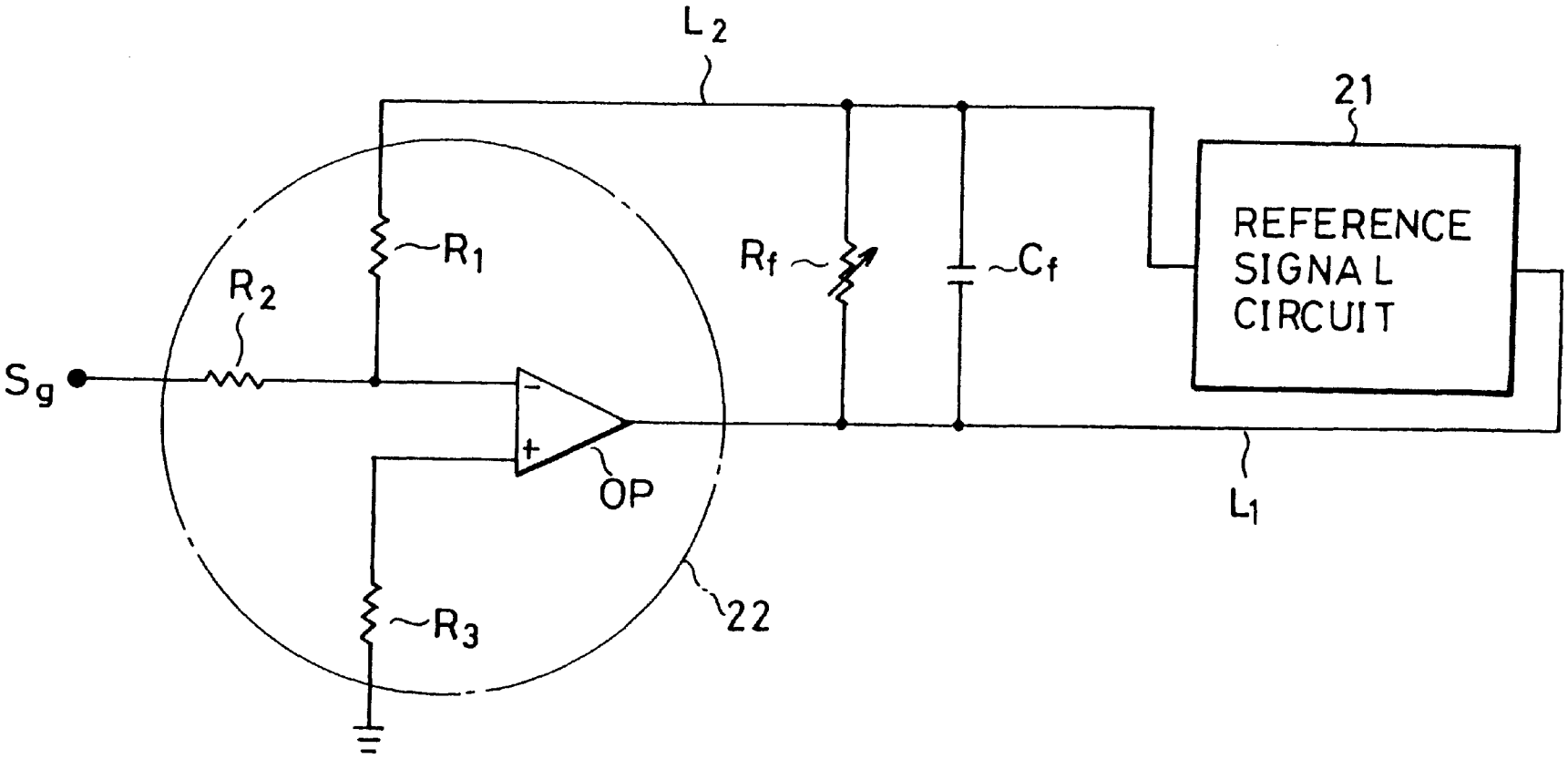
FIG. 4 is a circuit diagram that shows wiring between a reference signal circuit constituted by reference signal lines and a reference signal main line and a voltage applying circuit for applying a voltage to the reference signal circuit.

FIG. 4 is a circuit diagram that shows wiring of a reference signal circuit 21 constituted by the reference signal lines 7 and the reference signal main line 9 and a voltage-applying circuit 22 for applying a voltage to the reference signal circuit 21. The voltage-applying circuit 22 amplifies an input reference signal Sg by using an operational amplifier (adjustment means) OP so that a voltage is applied to the reference signal circuit 21 through a voltage application line L1. Moreover, a voltage feedback line L2 is connected to the reference signal circuit 21 so that a voltage of the reference signal circuit 21 at the connecting point is fed back to the voltage-applying circuit 22. The voltage feedback line L2 is connected to a signal input line of the operational amplifier OP through a resistor R1 so that the amplification factor of the reference signal Sg is determined by the value of the resistor R1 and the value of a resistor R2 connected to the input section of the reference signal Sg. Moreover, a resistor R3, which is connected to the ground input of the operational amplifier OP, is used for setting an offset voltage in the reference signal circuit 21.

Moreover, the voltage application line L1 and the voltage feedback line L2 are connected in parallel with each other by using a capacitor Cf and a resistor Rf. The resistor Rf is a variable resistor, and the value of the resistor is varied so that the amount of feedback from the voltage feedback line L2 to the voltage-applying line L1, that is, the amplification factor of the voltage can be changed.

In the present embodiment, the reference signal circuit 21 and the voltage-applying circuit 22 are connected in a manner as described above; therefore, the following functions and effects are obtained. Even in the case when the reference signal voltage becomes irregular due to the distribution of resistances and capacitances of the respective wires within the display panel, the voltage feedback line L2 feeds a variation in the reference voltage back to the voltage-applying circuit 22 so that the degree of amplification of the operational amplifier can be changed in a direction so as to make the applied voltage constant. Therefore, this makes it possible to apply a uniform reference signal voltage to the inside of the display panel; thus, it becomes possible to reduce the generation of shadowing due to a delay in the reference signal, and consequently to prevent degradation in the display quality.

Here, too large an amount of voltage feedback from the voltage feedback line L2 tends to give adverse effects to normally displaying portions, causing difficulties in carrying out normal display. In order to prevent this problem, it is necessary to adjust the amplification factor (the amount of feedback) of the operational amplifier so as to provide an optimal display while preventing shadowing by properly adjusting the resistivity of the resistor Rf that connects the voltage feedback line L2 and the voltage-applying line L1.

Next, an explanation will be given of a specific arrangement of the reference signal circuit 21 in accordance with the present embodiment.

Figure 1:
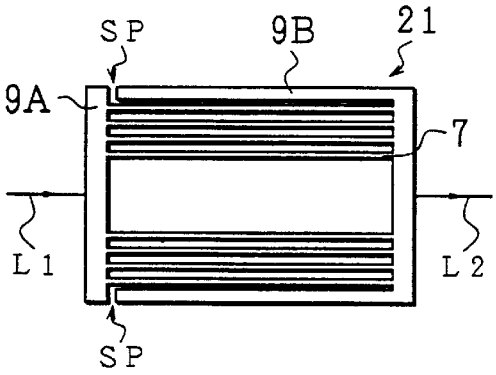
FIGS. 1(*a*) through 1(*f*) are schematic drawings each of which shows a simplified example of a simplified construction of a reference signal circuit installed in a liquid crystal display in accordance with one embodiment of the present invention.
Figure 1:
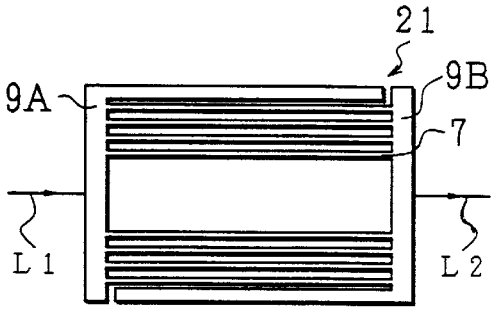
Figure 1:
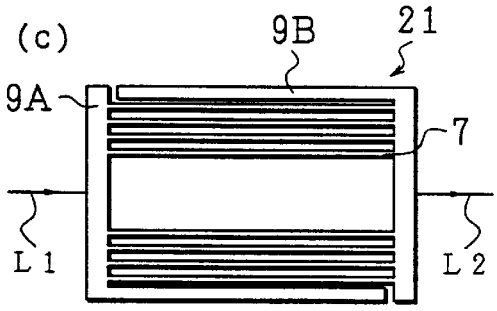
Figure 1:
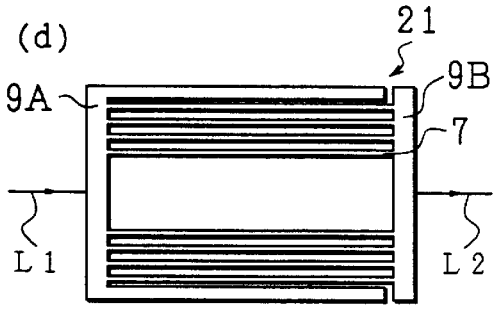
Figure 1:
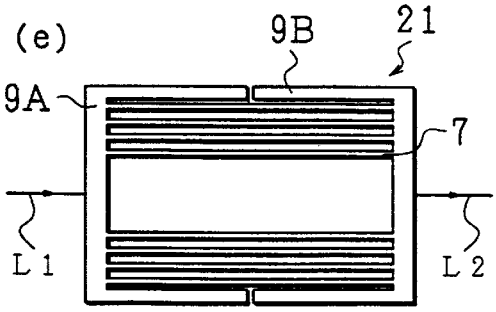
Figure 1:
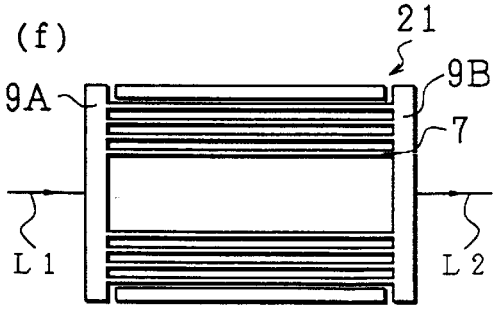

FIGS. 1(*a*) through 1(*f*) are schematic drawings each of which shows a simplified structural example of the construction of the reference signal circuit 21. This structural example of the reference signal circuit 21 is arranged in such a manner that, in the event of a minute voltage variation within the reference signal circuit 21, the variation is detected and the corresponding feedback is made to the voltage applying circuit 22 so as to compensate for the variation.

Figure 20:
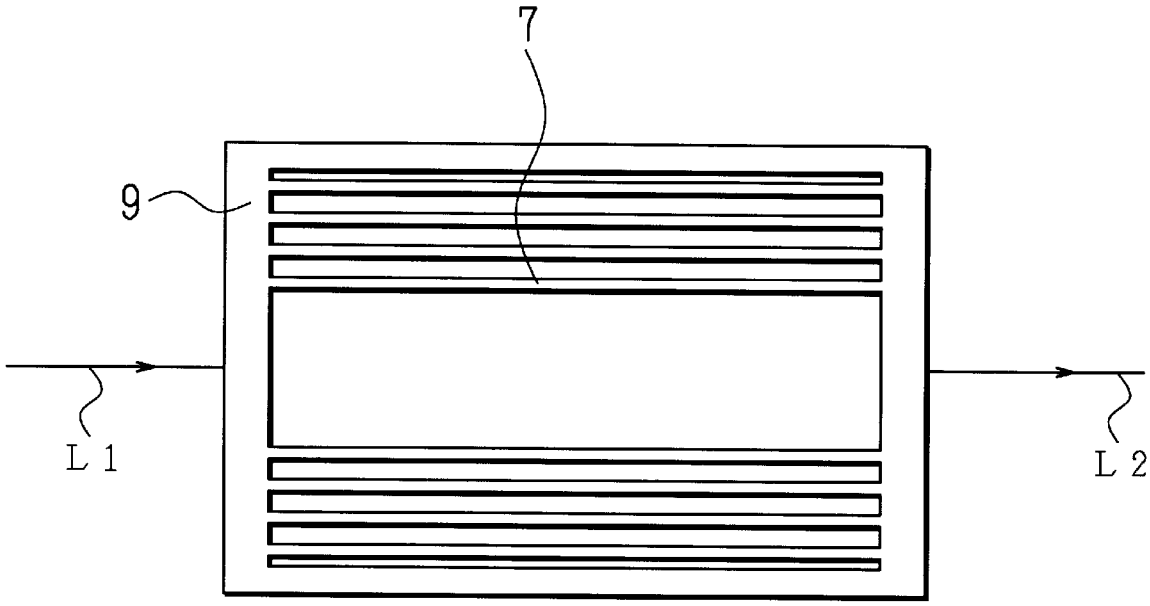
FIG. 20 is a plan view that shows the reference signal circuit having an arrangement as a comparative example in which the reference signa main line surrounds the display panel.
Figures 21A, 21B:
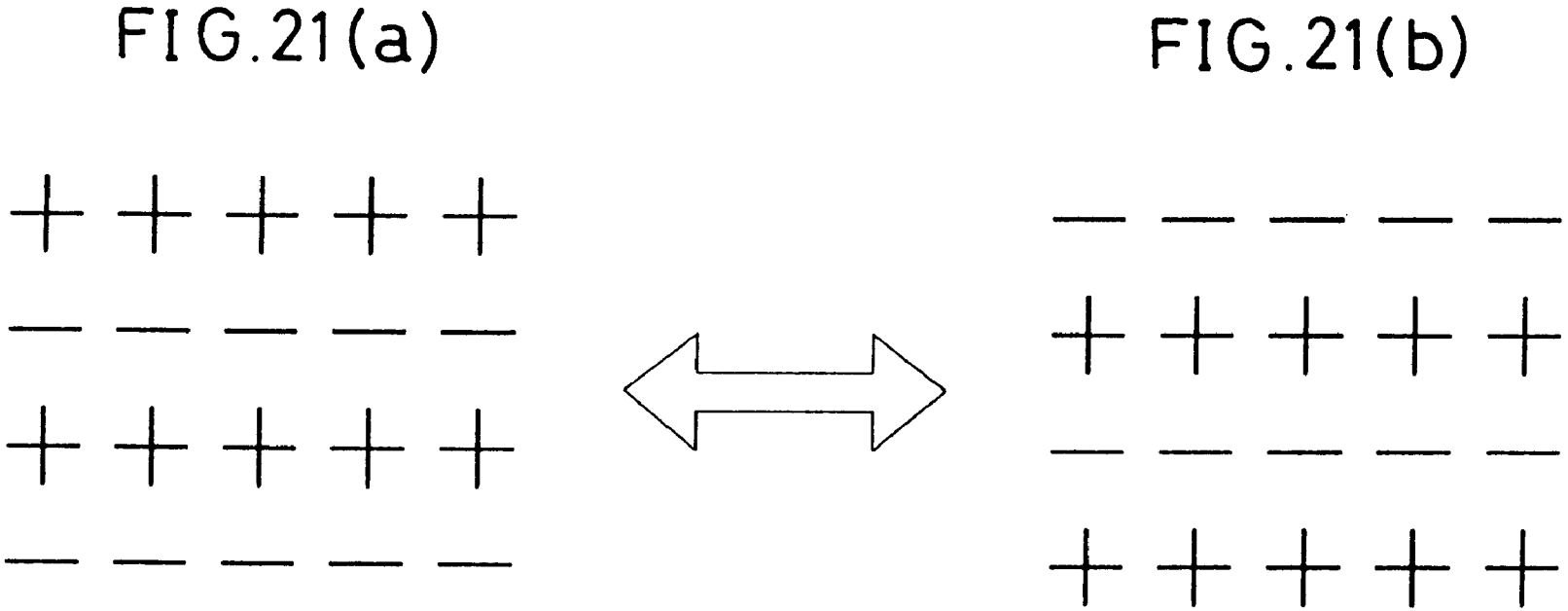
FIGS. 21(*a*) and 21(*b*) are explanatory drawings each of which shows one portion of the polarity of a voltage that is applied to each pixel in a dot-inversion driving system.
Figure 22B:
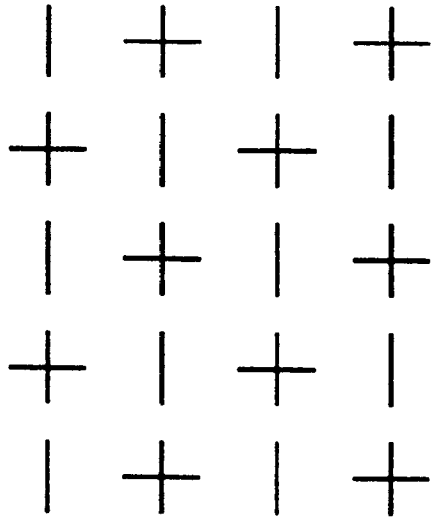
FIGS. 22(*a*) and 22(*b*) are explanatory drawings each of which shows one portion of the polarity of a voltage that is applied to each pixel in a dot-inversion driving system.
Figure 22B:
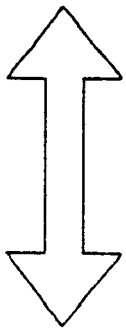
Figure 22A:
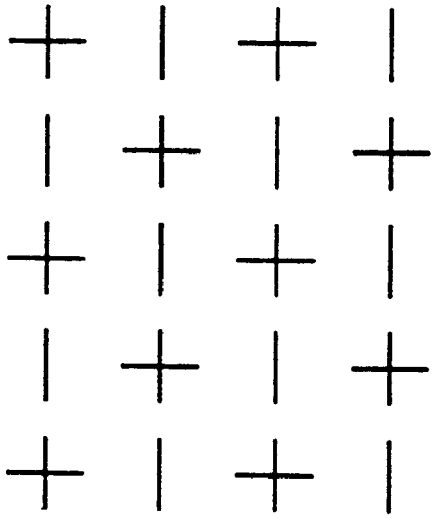
Figure 23:
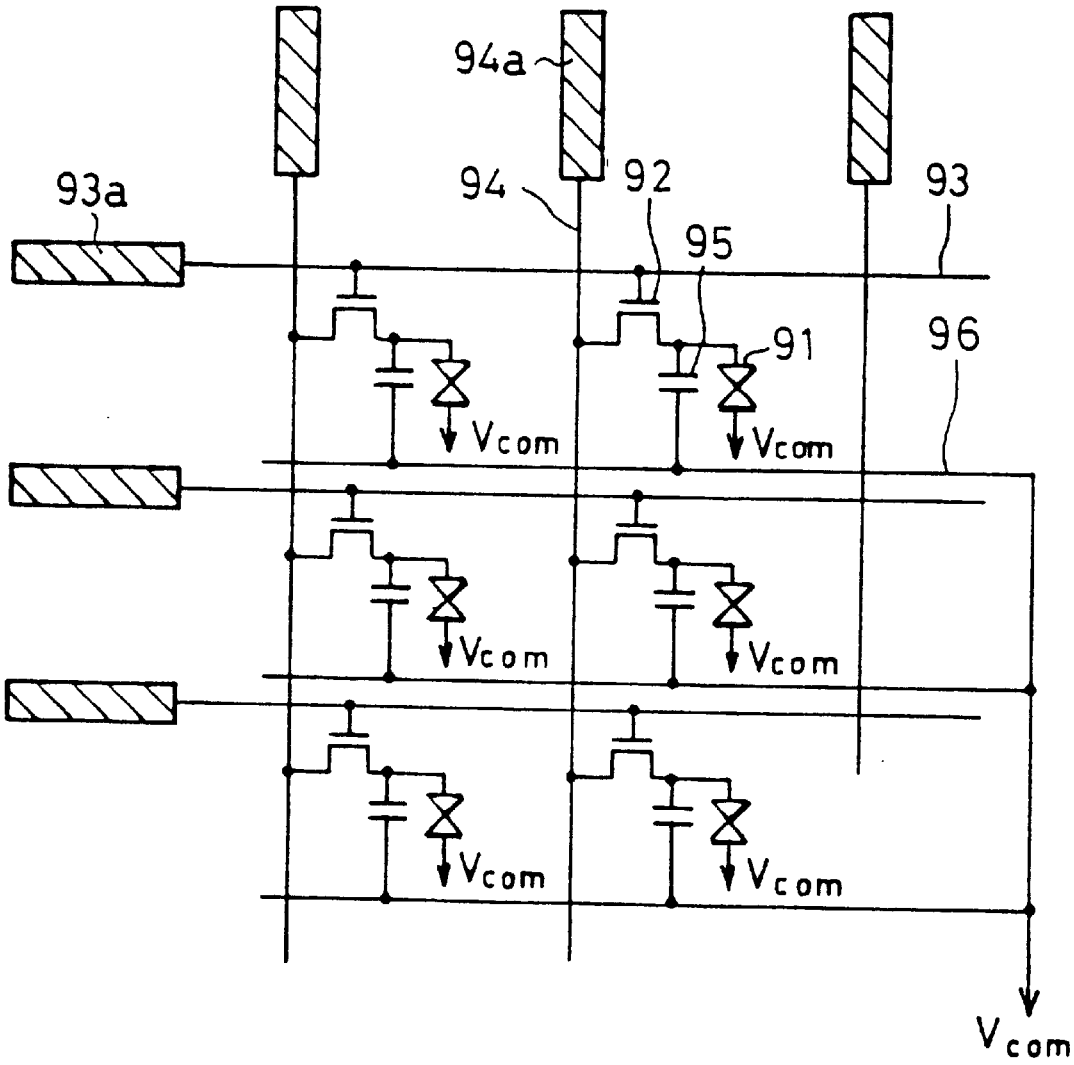
FIG. 23 is a circuit diagram that schematically shows one example of an active-matrix circuit in an active-matrix substrate having a conventional construction.
Figure 24:
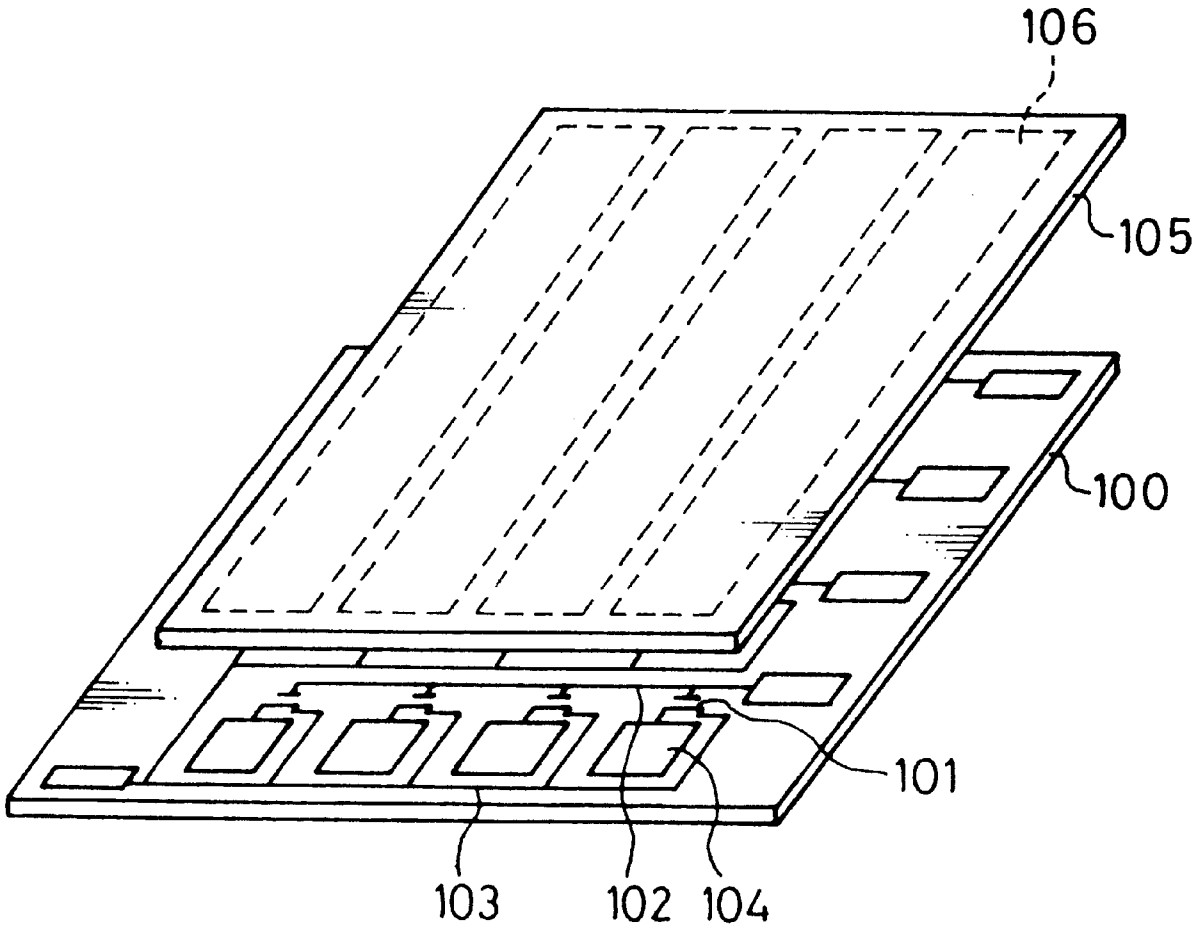
FIG. 24 is a schematic perspective view that shows an arrangement of a liquid crystal display having the opposing source construction.

First, an explanation will be given of a reference signal circuit shown in FIG. 20 as a comparative example. Normally, the reference signal main line 9 also needs to function as a light-shielding member, with the result that it is often formed into a shape considerably thicker than each of the reference signal lines 7 within the display panel. As a result, the resistivity of the reference signal main line 9 becomes smaller than the resistivity of the reference signal line 7, and upon application of a voltage, a more current is allowed to flow toward the reference signal main line 9 that has a smaller resistivity. Therefore, with respect to the voltage variation detected by the voltage detection section, more variations in the reference signal main line 9 tend to be detected as compared with variations in the reference signal lines 7 within the display panel, resulting in a failure in accurately detect and compensate for minute voltage variations within the display panel. In contrast, the liquid crystal display of the present embodiment can solve the above-mentioned problem by installing a reference signal circuit having an arrangement as described below.

In an arrangement shown in FIG. 1(*a*), the reference signal circuit 21 is arranged in such a manner that the reference signal main line 9 is separated to an input main line (partial main line) 9A and an output main line (partial main line) 9B when it is patterned; thus, the voltage variation inside the reference signal circuit 21 is fed back to the voltage-applying circuit 22 by connecting the voltage application line L1 and the voltage feedback line L2. In other words, in order to appropriately feed the voltage variation in the reference signal circuit 21 back to the voltage application circuit, the portion for applying the reference voltage and the portion for feeding back the reference voltage are provided in a separated manner. With this arrangement, even a minute voltage variation occurring inside the reference signal circuit 21 can be detected, and the voltage application circuit adjusts the application voltage in accordance, with the voltage variation so that the reference signal voltage can be compensated.

In order to make the reference signal voltage uniform inside the display panel and provide a superior display by compensating the voltage of the reference signal, it is necessary to take the following point into consideration. As described above, the above-mentioned arrangement makes it possible to control the amount of feedback (amplification factor) to an optimal value so as to reduce shadowing by adjusting the resistivity of the resistor Rf. However, since the amplification factor is always maintained at a constant value with respect to the entire display panel, in order to carry out a uniform voltage compensation with respect to the entire display panel, the voltage detection portion needs to be set at a portion in which the impedance of the entire reference signal circuit 21 is accurately detected, that is, a portion which hardly susceptible to influences of unnecessary impedances from portions not related to display. Therefore, the separation of the reference signal main line 9 should be designed by taking the above-mentioned point into consideration.

Moreover, since the reference signal main line 9 also functions as a light-shielding member, it is also necessary to keep the separation area SP between the input main line 9A and the output main line 9B as small as possible upon separating the input and output by means of patterning.

In an arrangement as shown in FIG. 1(*a*), the reference signal main line 9 is separated at an upper left portion and a lower left portion in the Figure so as to form the input main line 9A and the output main line 9B. In this arrangement, the reference signal voltage can be applied while eliminating the influences of impedances from the upper side portion and lower side portion of the reference signal main line 9.

In an arrangement as shown in FIG. 1(*b*), the reference signal main line 9 is separated at an upper right portion and a lower left portion in the Figure so as to form the input main line 9A and the output main line 9B. In this arrangement, the reference signal voltage can be detected while eliminating the influences of impedances from the upper side portion of the reference signal main line 9.

In an arrangement as shown in FIG. 1(*c*), the reference signal main line 9 is separated at an upper left portion and a lower right portion in the Figure so as to form the input main line 9A and the output main line 9B. In this arrangement, the reference signal voltage can be detected while eliminating the influences of impedances from the lower side portion of the reference signal main line 9.

In an arrangement as shown in FIG. 1(*d*), the reference signal main line 9 is separated at an upper right portion and a lower right portion in the Figure so as to form the input main line 9A and the output main line 9B. In this arrangement, the reference signal voltage can be detected while eliminating the influences of impedances from both of the upper side portion and lower side portion of the reference signal main line 9.

In an arrangement as shown in FIG. 1(*e*), the reference signal main line 9 is separated at an upper center portion and a lower center portion in the Figure so as to form the input main line 9A and the output main line 9B. In this arrangement, both of the detection of the reference signal voltage and the application of the reference signal voltage can be carried out under the same influences of impedances from the upper side portion and lower side portion of the reference signal main line 9.

In an arrangement as shown in FIG. 1(*f*), the reference signal main line 9 is separated at four portions, that is, upper left, lower left, upper right and lower left portions, in the Figure so as to form the input main line 9A and the output main line 9B. In this arrangement, the reference signal voltage can be detected and also can be applied while eliminating the influences of impedances from both of the upper side portion and lower side portion of the reference signal main line 9.

As described above, at the time of applying the reference signal voltage as well as detecting the reference signal voltage, the influences of impedances from the reference signal main line 9 can be minimized so that it is possible to detect even a minute voltage variation in the reference signal lines 7 inside the reference signal circuit 21 more accurately and consequently to compensate for the variation. Thus, it becomes possible to improve the display quality of the liquid crystal display.

Next, referring to FIGS. 5(*a*) and 5(*b*), an explanation will be given of an arrangement in which, different from the above-mentioned arrangement in which the reference signal main line 9 is separated at the time of patterning, the input and output separation with respect to the reference signal circuit 21 is provided by adjusting impedances.

Figure 5:
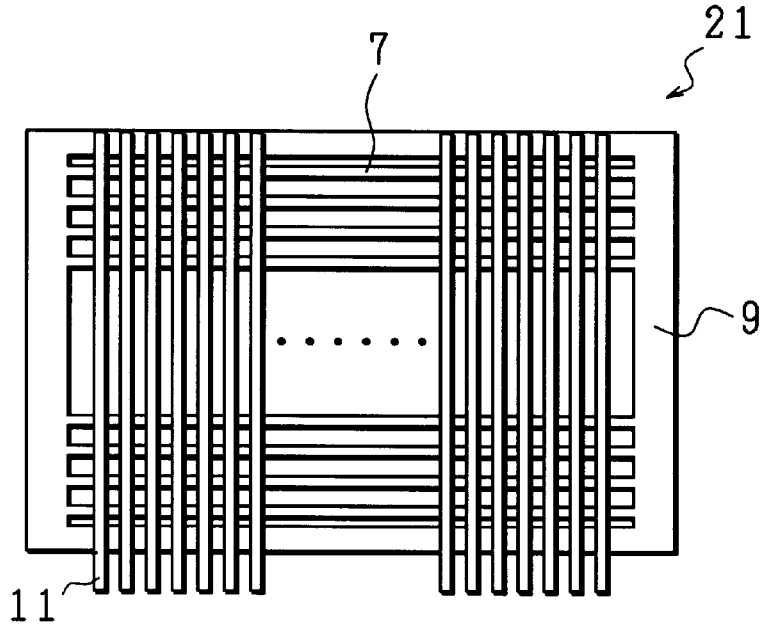
FIG. 5(*a*) is a plan view that shows the reference signal circuit having an arrangement for providing high impedances on the upper side section and lower side section of the reference signal main line, and FIG. 5(*b*) is a schematic drawing thereof.
Figure 5:
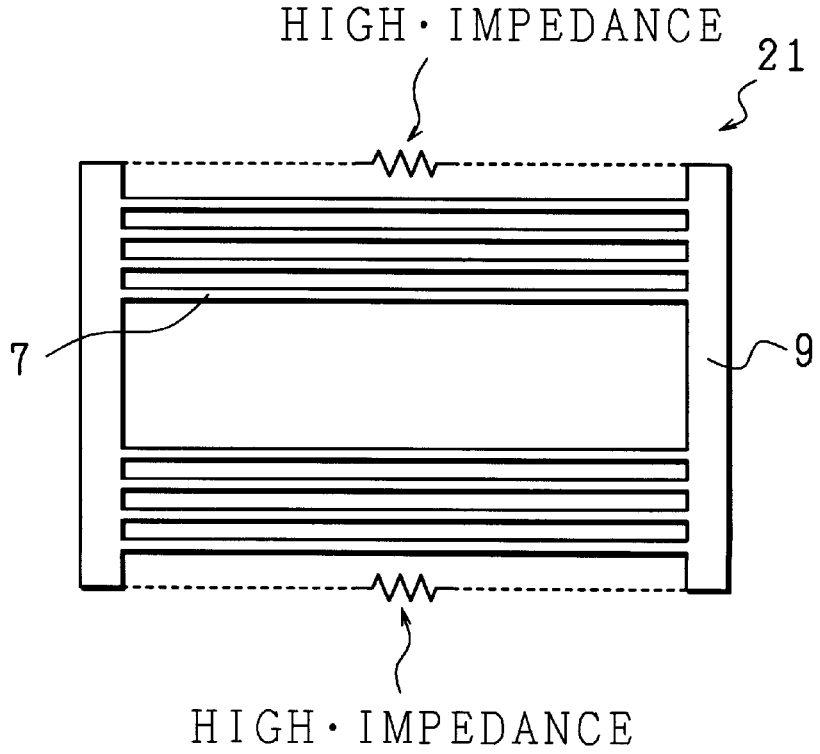

In FIG. 5(*a*), in the case when the source driver to which the gradation signal is inputted is placed on the lower side of the display panel, the gradation signal lines 11 connected to the source driver are supposed to be placed at the lower side portion of the reference signal main line 9 on the opposing substrate 2. In this case, a capacitance is formed between the gradation signal lines 11 and the lower side portion of the reference signal main line 9, with the result that the lower side portion of the reference signal main line 9 has a very high impedance. Similarly, when the gradation signal lines 11 are formed up to a position corresponding to the upper side portion of the reference signal main line 9, a capacitance is formed between the upper side portion of the reference signal main line 9 and the gradation signal lines 11 so that the upper side portion of the reference signal main line 9 is allowed to have a high impedance. In other words, this arrangement allows both the upper side portion and the lower side portion of the reference signal main line 9 to have high impedances respectively so that less currents are allowed to flow in the upper side portion and the lower side portion of the reference signal main line 9 by such adjustments in impedances. FIG. 5(*b*) schematically shows a state in which the upper side portion and the lower side portion of the reference signal main line 9 become high.

In the above-mentioned arrangement, the impedances are raised by increasing the capacitances generated in the upper side portion and the lower side portion of the reference signal main line 9; however, the impedances may be raised by increasing resistivities by narrowing the line widths in the upper side portion and the lower side portion of the reference signal main line 9. However, the narrowed line widths in the upper side portion and the lower side portion of the reference signal main line 9 raise another problem of degradation in the light-shielding property.

Figure 6:
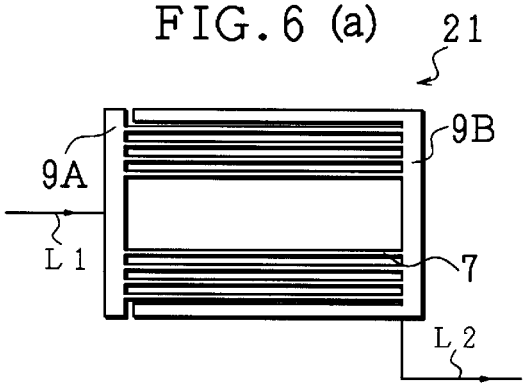
FIGS. 6(*a*) through 6(*g*) are plan views each of which is an example showing how to connect a voltage applying line and a voltage feedback line to the reference signal circuit.
Figure 6:
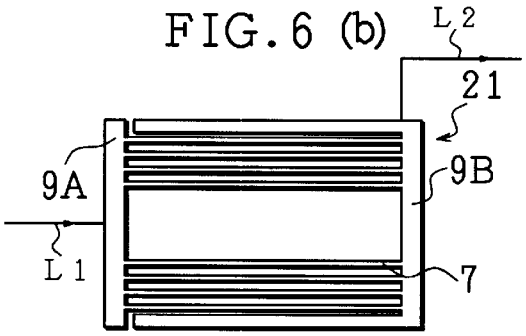
Figure 6:
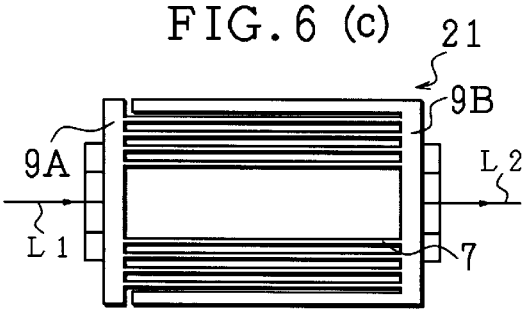
Figure 6:
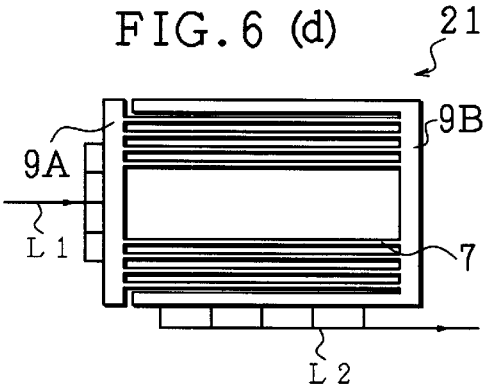
Figure 6:
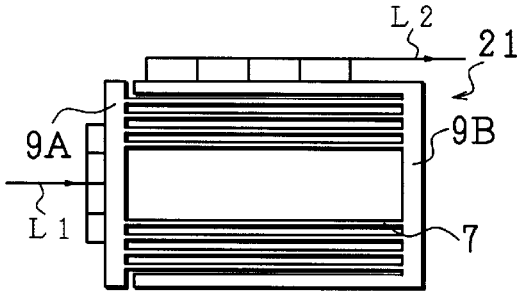
Figure 6:
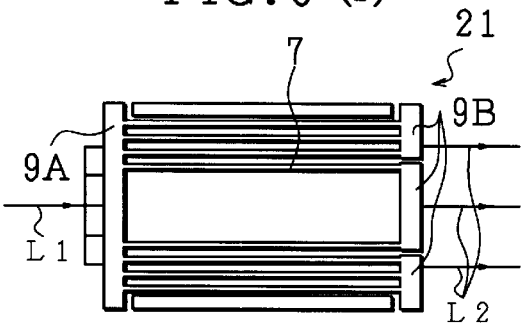
Figure 6:
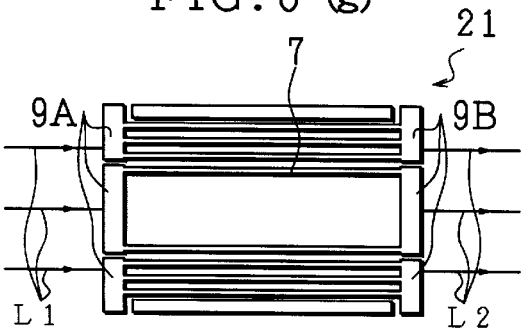

Next, referring to FIGS. 6(*a*) through 6(*g*), the following description will discuss examples of the connection of the voltage application line L1 and the voltage feedback line L2 to the reference signal line 21.

FIGS. 6(*a*) and 6(*b*) show examples in which the connection portion of the voltage feedback line L2 to the reference signal circuit 21 is changed. In this manner, the connection portion of the voltage feedback line L2 to the reference signal circuit 21 is not limited to the center of the right side portion of the reference signal main line 9, and the position may be freely changed depending on mutual positional relationships with the other components in the liquid crystal display.

Moreover, the connection portions of the voltage application line L1 and the voltage feedback line L2 to the reference signal circuit 21 are not limited to one portion, and they may be connected at a plurality of portions. FIGS. 6(*c*) through 6(*e*) respectively show structural examples in which a plurality of connection portions to the reference signal circuit 21 are provided for the voltage application line L1 and the voltage feedback line L2. This arrangement in which a plurality of connection portions to the reference signal circuit 21 are provided for the voltage application line L1 and the voltage feedback line L2 makes it possible to detect a minute voltage variation in the reference signal circuit 21 more accurately. Consequently, it becomes possible to further improve the display quality.

In order to detect the voltage variation with more precision, an arrangement as shown in FIG. 6(*f*) may be proposed. In this arrangement, the output main line 9B is separated into three blocks, and the voltage variation is detected for each block. With this arrangement, it is possible to detect and compensate for a minute voltage variation in the reference signal circuit 21 more accurately. Here, the number in which the output main line 9B is separated is not intended to be limited by three, two or not less than three may of course be adopted.

Moreover, as illustrated in FIG. 6(*g*), not only the output main line 9B, but also the input main line 9A, may be separated into a plurality of blocks; thus, it becomes possible to detect and compensate for a minute voltage variation in the reference signal circuit 21 more accurately.

Figures 16A, 16B:
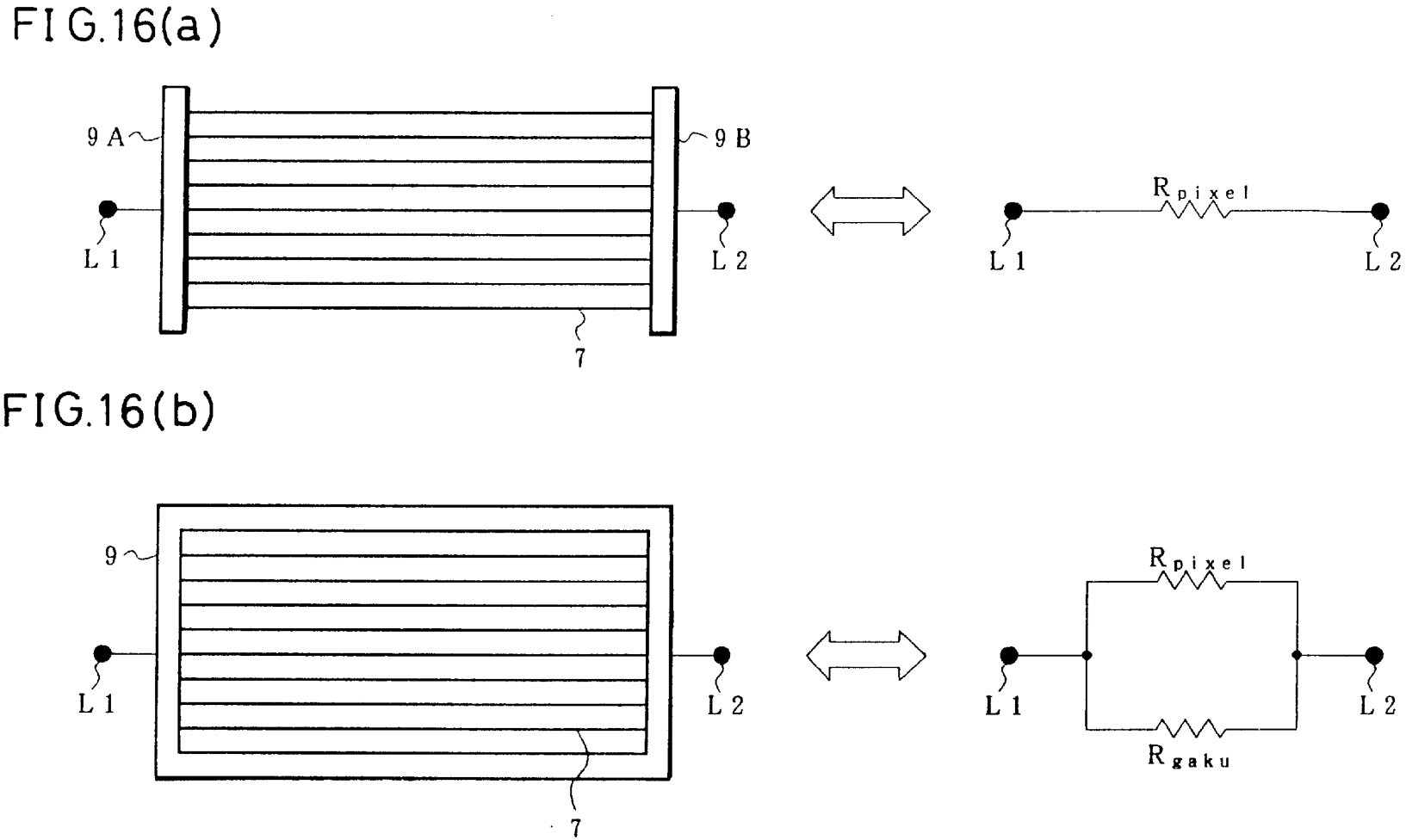
FIG. 16(*a*) is an explanatory drawing that shows an arrangement of the reference signal circuit in the case when the reference signal main line is divided into a plurality of portions, and FIG. 16(*b*) is an explanatory drawing that shows an arrangement of the reference signal circuit in the case when the reference signal main line is placed in a manner so as to entirely surround the display panel.

Here, the following description will discuss the relationship on impedances in the reference signal circuit 21 in more detail. Here, suppose that the total impedance of all the reference signal lines 7 is Rpixel and that the impedance of the reference signal main line 9 is Rgaku. As shown in FIG. 16(*b*), in the case when the reference signal main line 9 is installed in such a manner so as to surround all the periphery of the display panel, an impedance between the voltage application line L1 and the voltage feedback line L2 is given as a parallel impedance between Rpixel and Rgaku. At this time, if the impedance of Rgaku is not sufficiently great as compared with that of Rpixel, the sensitivity for reducing shadowing in the display pixel becomes low due to the variation in the amplification factor of the operational amplifier OP. Therefore, as illustrated in FIG. 16(*a*), in order to sufficiently increase Rgaku, it is necessary to separate the reference signal main line 9 into a plurality portions. In this manner, the reference signal main line 9 is separated into the input main line 9A and the output main line 9B so that Rgaku is reduced to a level that is virtually ignorable, thereby making it possible to improve the sensitivity to the amplification variation of the operational amplifier OP. In other words, it is more effective to use the arrangement of FIG. 16(*a*) than to use the arrangement of FIG. 16(*b*) in an attempt to reduce shadowing.

In the arrangement of FIG. 16(*a*), in the case when the impedance of each of the input main line 9A and the output main line 9B is set sufficiently smaller than the impedance Rpixel of all the reference signal lines 7 in the reference signal circuit 21, the impedance of each reference signal line 7 to the operational amplifier OP is made uniform. Therefore, when the same metal layer is used to form the reference signal lines 7 and the reference signal main line 9 in the reference signal circuit 21, it is more preferable to make the line width of the reference signal main line 9 sufficiently thicker than the line width of the reference signal line 7.

In FIG. 16(*a*), when each of the impedances of the input main line 9A and the output main line 9B is set sufficiently smaller than the impedance Rpixel of all the reference signal lines 7 in the reference signal circuit 21, the impedances of the respective reference signal lines 7 are made uniform with respect to the operational amplifier OP. Therefore, in the case when the same metal layer is used to form the reference signal lines 7 and the reference signal main line 9 in the reference signal circuit 21, it is preferable to make the line width of the reference signal main line 9 sufficiently thicker than the line width of the reference signal line 7.

Figure 15:
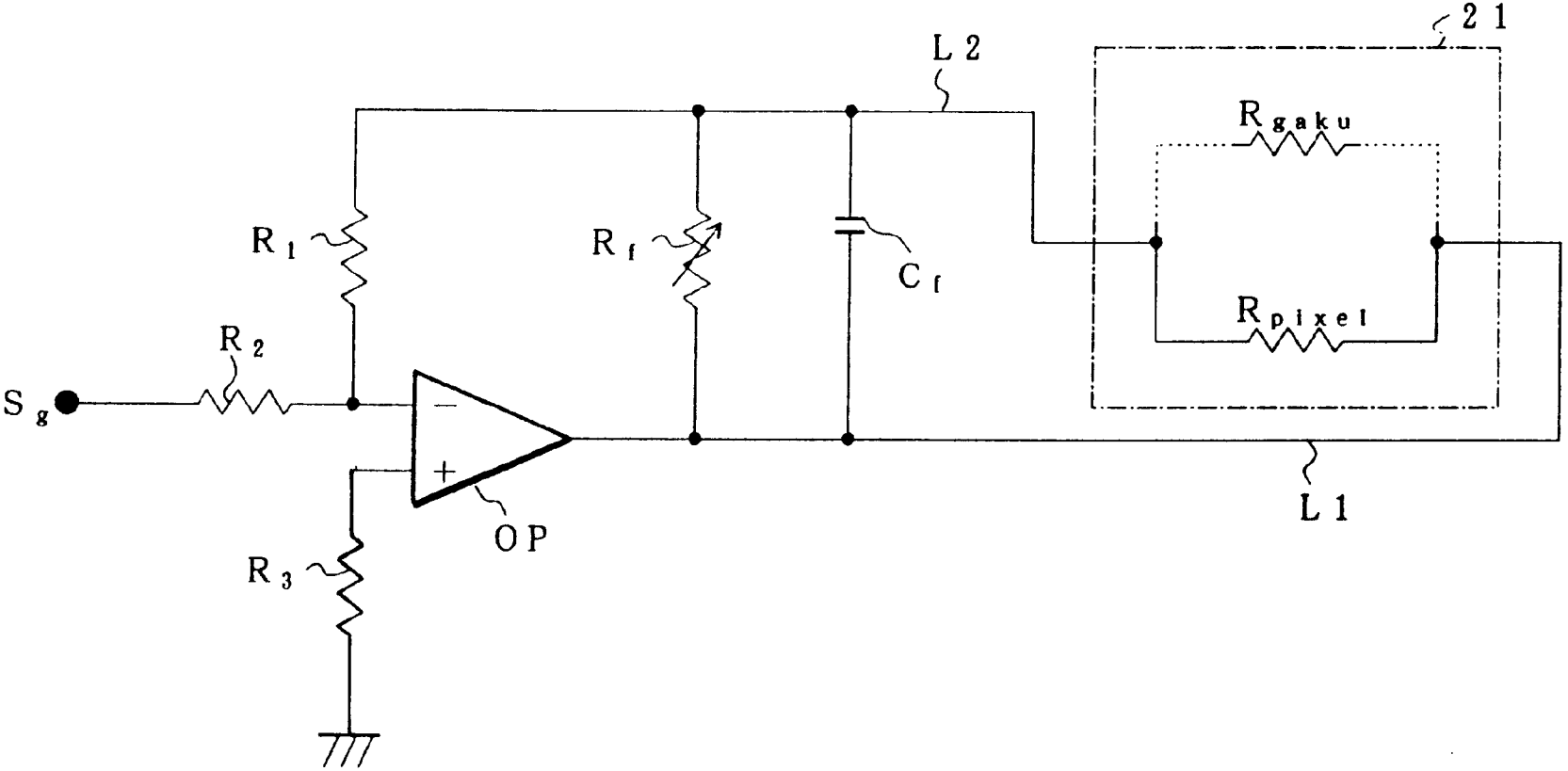
FIG. 15 is a circuit diagram that shows wiring between the reference signal circuit which indicates an impedance of the reference signal line and an impedance of the reference signal main line and the voltage applying circuit for applying a voltage to the reference signal line.
Figure 17:
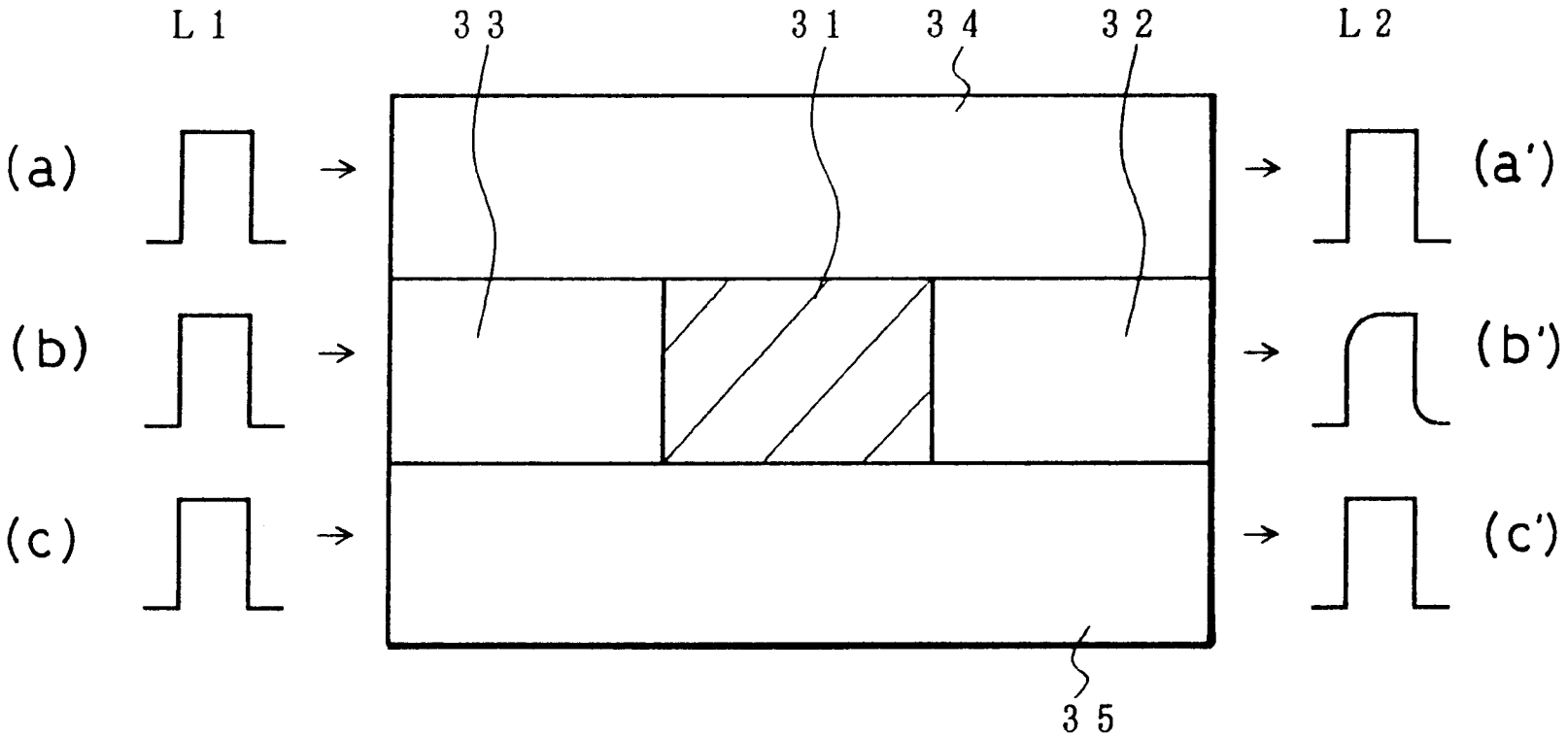
FIG. 17 is an explanatory drawing that shows input waveforms that are inputted to respective areas on a display screen from voltage applying lines in the case when a shadowing pattern is displayed on the display screen, as well as output waveforms that are fed back to voltage feedback lines from the respective areas on the display screen.

Next, an explanation will be given of a driving method for reducing shadowing in the liquid crystal display having the above-mentioned arrangement. Here, in FIG. 15, suppose that the impedance Rgaku of the reference signal main line 9 is sufficiently greater than the impedance Rpixel of all the reference signal lines 7 in the reference signal circuit 21, and that the influences from the impedance Rgaku are ignorable. FIG. 17 shows an explanatory drawing that shows an input waveform that is applied from the voltage-applying line L1 to the respective areas on the display screen and an output waveform that is fed back from the respective areas on the display screen to the voltage feedback line L2 when the shadowing pattern is displayed on the display screen.

The input reference signal Sg is amplified by the inversion amplification circuit constituted by the operational amplifier OP. In this case, the amplification factor at the time of ignoring the adjusting-use variable resistor Rf increases to two times the term−(Rpixel+R1)/R2.

Normally, in areas 34 and 35 in FIG. 17, in comparison with input waveforms (a) and (c) in the voltage-applying line L1, output waveforms (a') and (c') in the voltage feedback line L2 hardly have any changes; therefore, the amplification factor is maintained at two times the term−(Rpixel+R1)/R2. In contrast, in an area containing the black display area 31, in comparison with an input waveform (b), a change appears in an output waveform (b'), and the resulting output wave (b') derived from a delayed input waveform (b) is outputted. In the output waveform (b'), the rising of the voltage is delayed by the signal delay, resulting in a state in which the voltage supply is insufficient; and this state tends to cause shadowing.

Figure 18A:
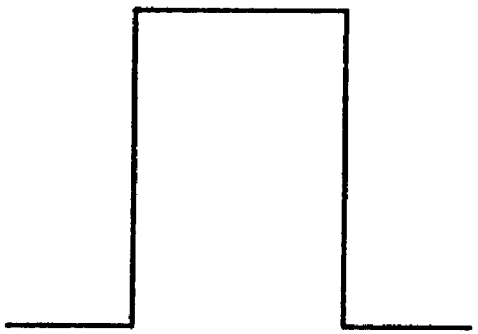
FIGS. 18(*a*) and 18(*b*) are explanatory drawings that show variations in the output waveform of the reference signal line.
Figure 18A:
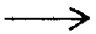
Figure 18B:
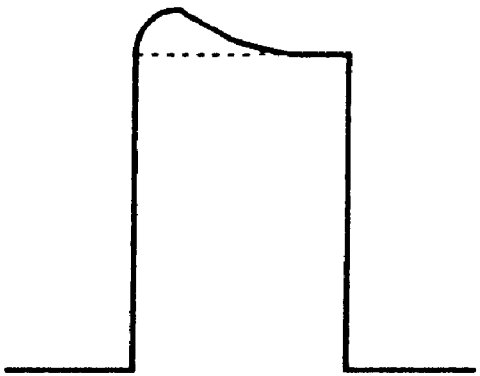
Figure 19:
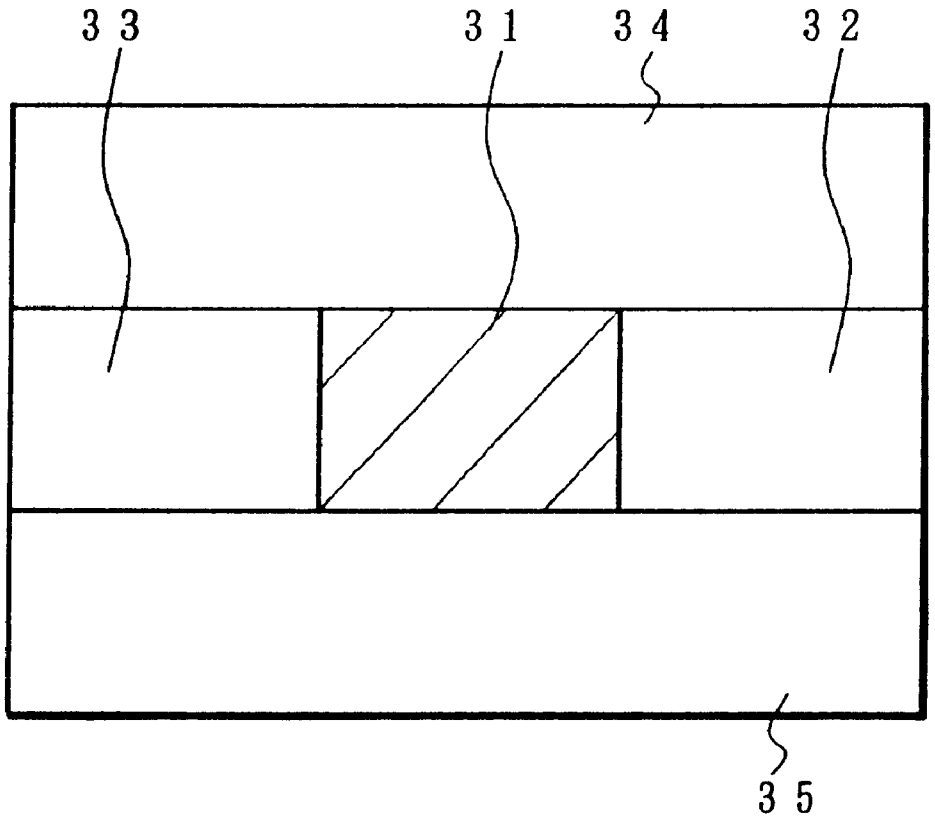
FIG. 19 is an explanatory drawing that shows the shadowing pattern.

In this state, however, the impedance Rpixel of the reference signal lines 7 becomes greater due to the difference between the output waveform (a') as well as (c') and the output waveform (b'). More specifically, in a portion of the output waveform (b') that gradually rises, an amplification factor greater than two times the term−(Rpixel+R1)/R2 can be obtained. Consequently, the input waveform in the voltage-applying line L1 is changed from a waveform shown in FIG. 18(*a*) to a waveform shown in FIG. 18(*b*). When the input voltage has a waveform shown in FIG. 18(*b*), the portion of the output waveform (b') that rises gradually in FIG. 17 is allowed to rise abruptly, thereby making it possible to eliminate the insufficiency in the voltage supply. Therefore, if no improving attempt is made, the area 32 appears whiter than the area 34 on the screen; however, the arrangement of the present embodiment makes it possible to provide virtually the same luminance to the area 34 and the area 32, and consequently to reduce shadowing.

Figure 7:
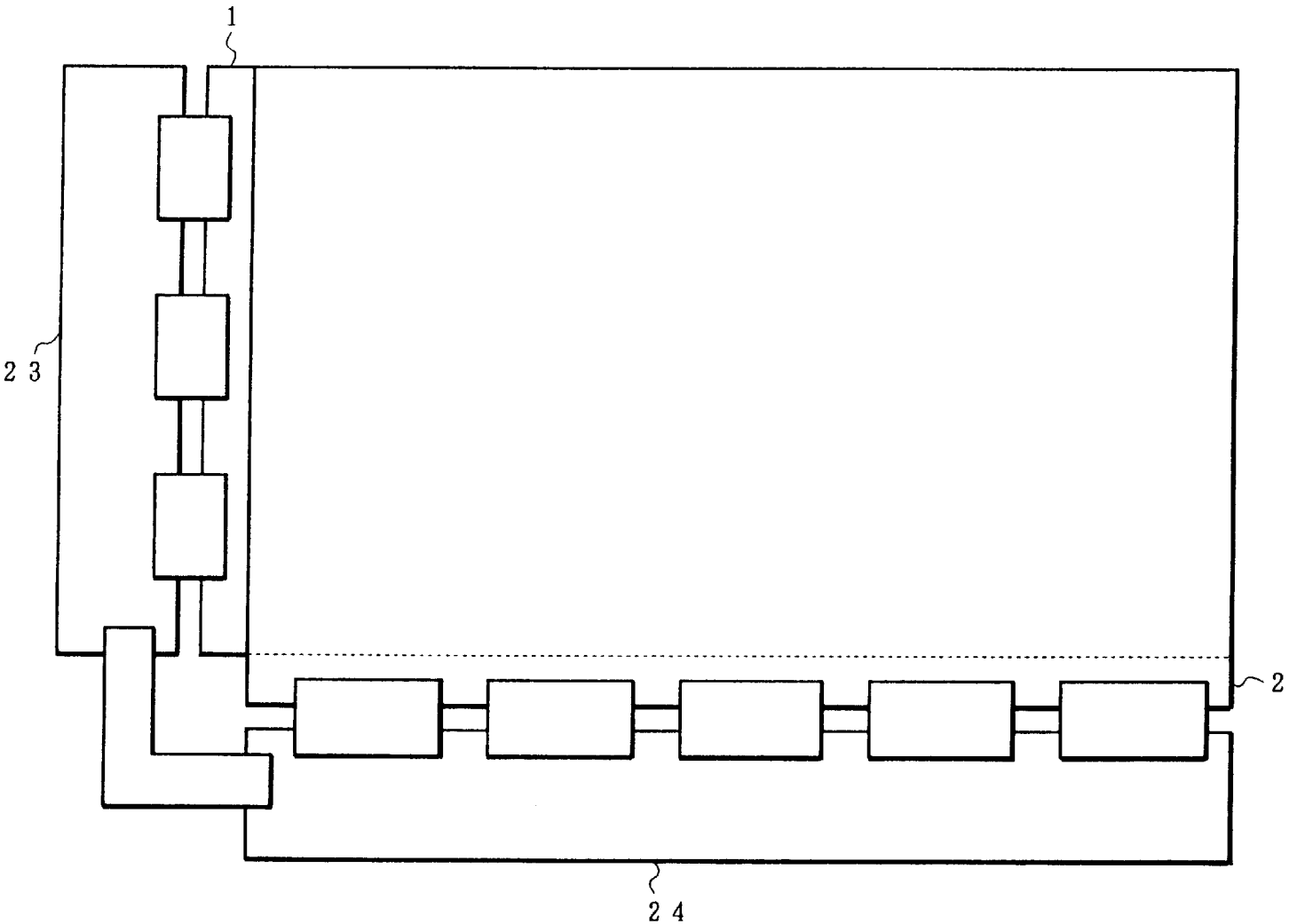
FIG. 7 is a plan view that shows an assembled state of a liquid crystal display having a normal opposing source construction.

Next, an explanation will be given of an assembling method of the liquid crystal display of the present embodiment. As illustrated in FIG. 7, in the normal opposing source structure, a gate control substrate 23 is placed in its connected state to the pixel substrate 1, and a source control substrate 24 is placed in its connected state to the opposing substrate 2.

Figure 8:
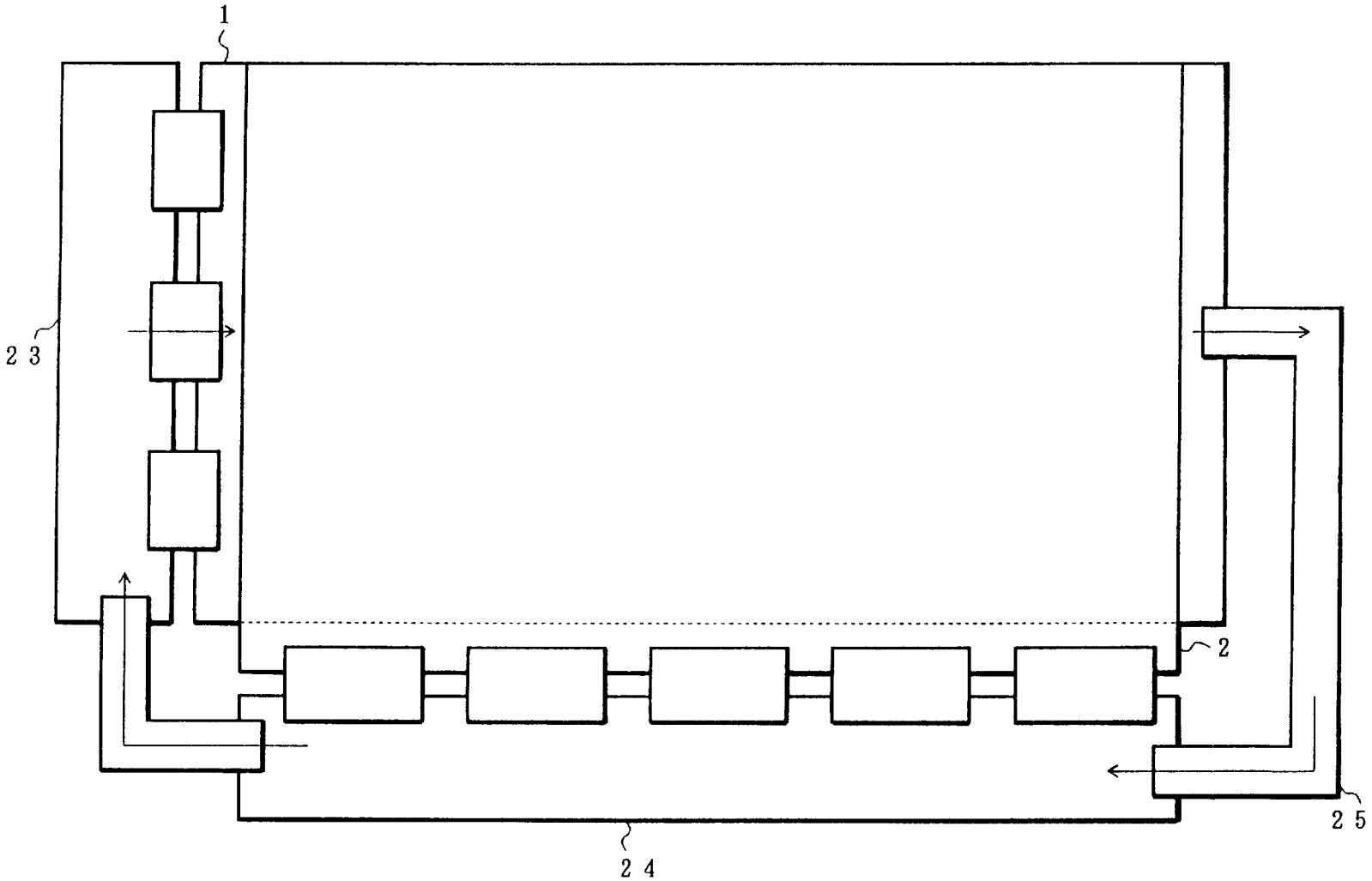
FIG. 8 is a plan view that shows an assembled state of the liquid crystal display in which a wiring substrate has been installed.

In the liquid crystal display of the present embodiment, the application portion and the detection portion for the reference signal voltage are placed on the pixel substrate 1 on which the reference signal circuit 21 is formed. Then, the voltage variation of the reference signal occurring in the reference signal circuit 21 is detected, and the voltage variation is transmitted to the voltage-applying circuit 22. In order to realize this construction, as illustrated in FIG. 8, it is proposed that, in addition to the gate control substrate 23 and the source control substrate 24, a wiring substrate 25 for transmitting the voltage variation is installed in its connected state to the pixel substrate 1, as shown in FIG. 8.

Figure 9:
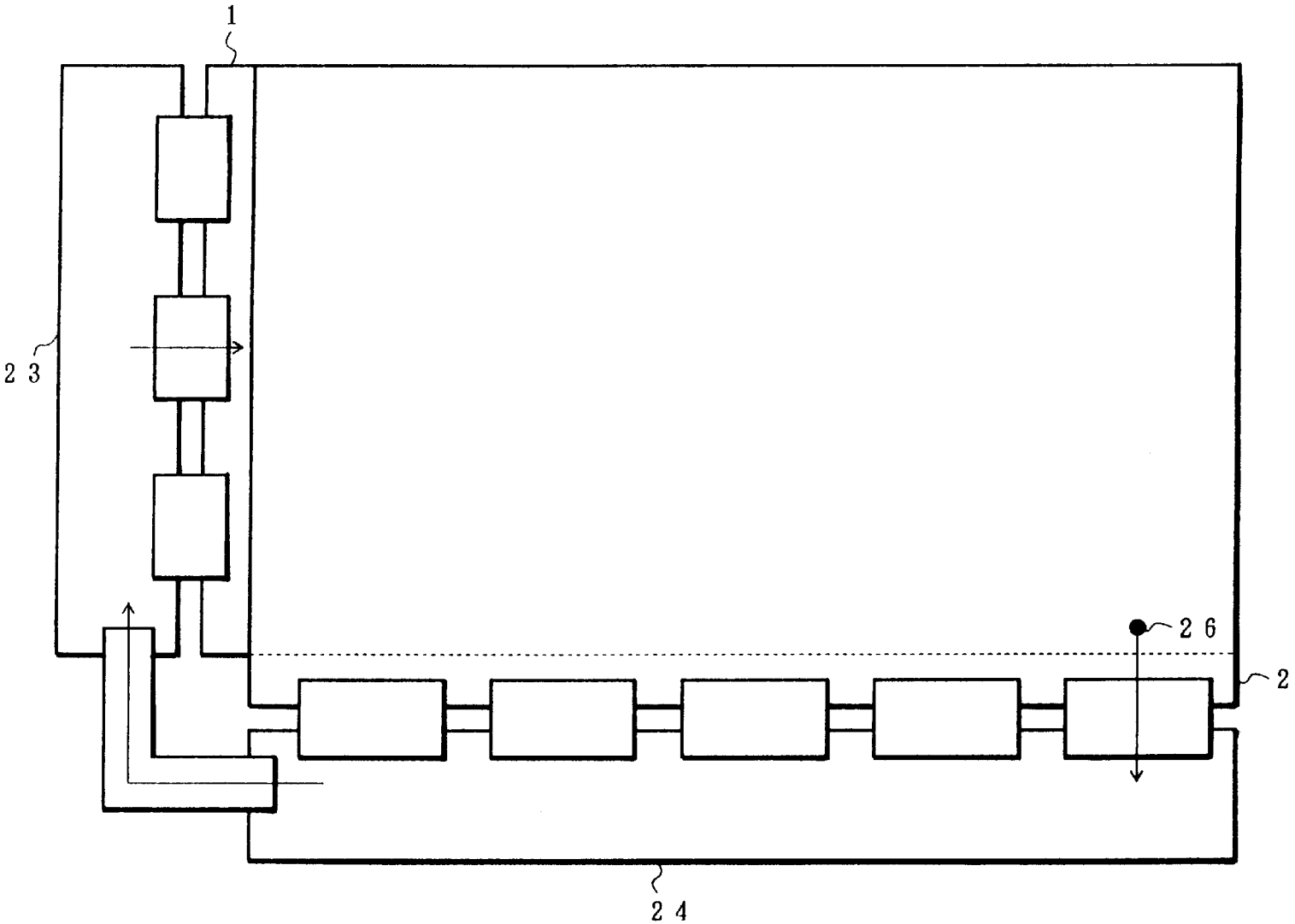
FIG. 9 is a plan view that shows an assembled state of the liquid crystal display in which a conductive section has been installed.

Moreover, as illustrated in FIG. 9, an arrangement may be made so as to detect the voltage variation of the reference signal circuit 21 on the pixel substrate 1 from the opposing substrate 2 through a conduction section 26 so that the voltage application portion and the voltage detection portion for the reference signal circuit 21 can be placed on respectively different substrates. In other words, the detected voltage variation is transmitted to the gate control substrate 23 on which the voltage-applying circuit 22 is formed through the conduction section 26 and the source control substrate 24. In this arrangement, it is possible to assemble the liquid crystal display of the present embodiment without the necessity of newly installing the wiring substrate 25 and changing the shape of the pixel substrate 1.

Figure 10:
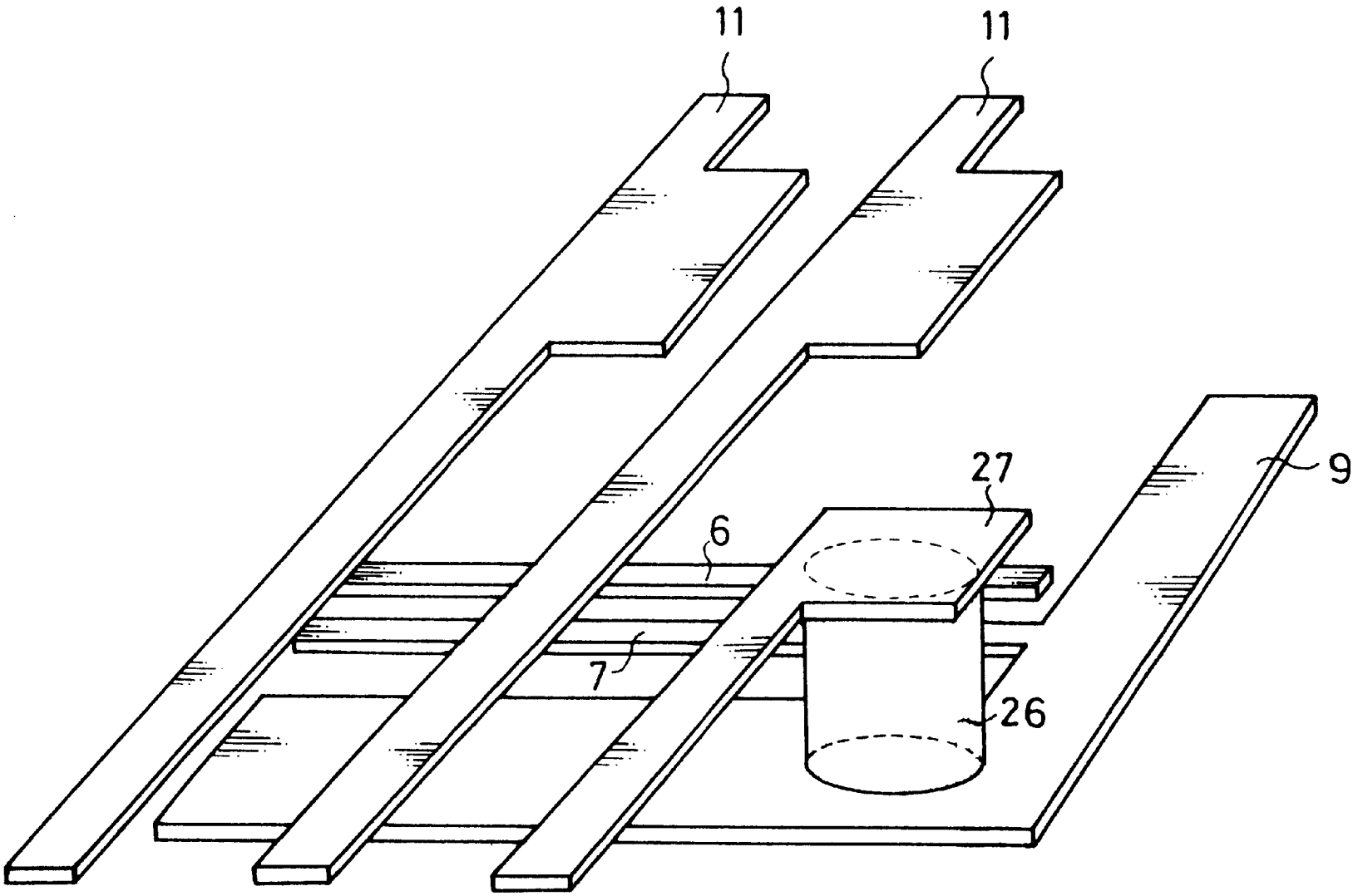
FIG. 10 is a perspective view that shows connections of wires on the pixel substrate, wires on the opposing substrate and the conductive section.
Figure 11:
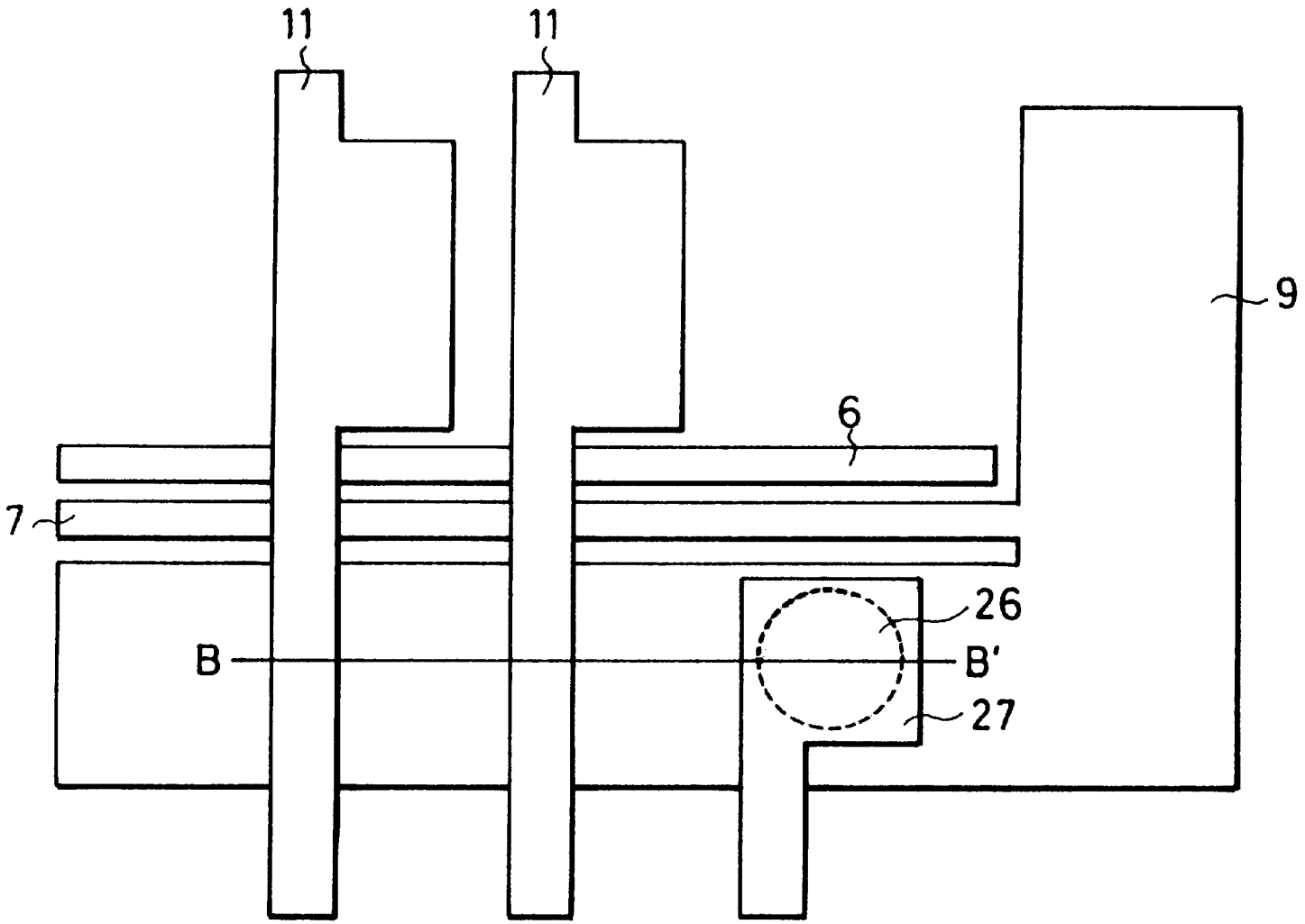
FIG. 11 is a plan view obtained when

Next, a detailed explanation will be given of the arrangement for detecting the voltage variation of the reference signal circuit 21 on the pixel substrate 1 from the opposing substrate 2 through the conduction section 26. FIG. 10 is a perspective view that shows a state in which the conduction section 26 is connected to wires on the pixel substrate 1 and wires on the opposing substrate 2; FIG. 11 is a plan view of FIG. 10; and FIG. 12 is a cross-sectional view taken along B—B' in FIG. 11.

FIG. 10 shows a gradation signal line 11 on the opposing substrate 2 side, a scanning line 6 on the pixel substrate 1 side, a reference signal line 7, a reference signal main line 9 and a conduction section 26. Moreover, a reference signal transfer pad 27 is placed on the opposing substrate 2 side so as to be connected to the conduction section 26.

Figure 12:
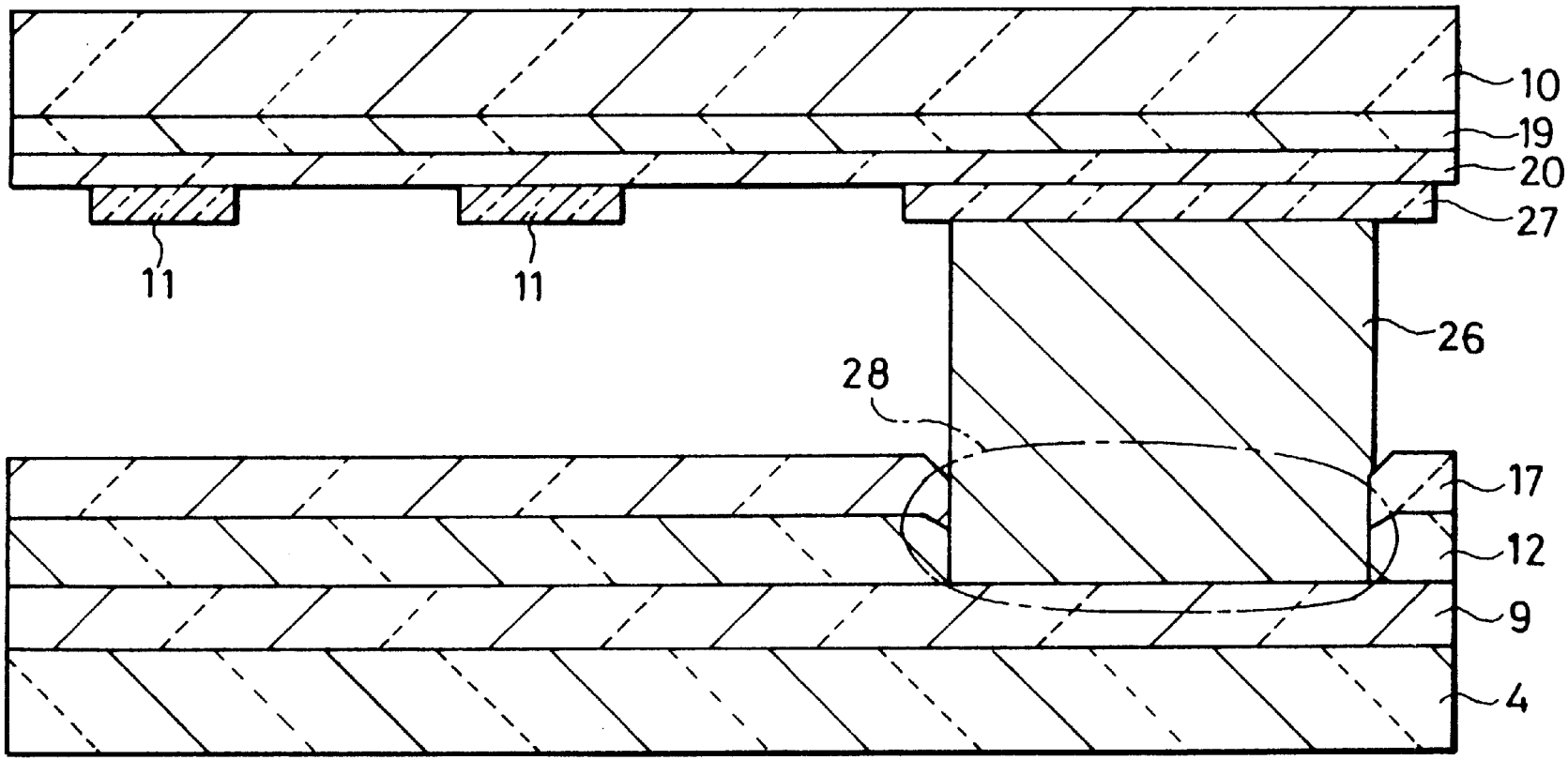
FIG. 12 is a cross-sectional view taken along line B—B' in FIG. 11.

As illustrated in FIG. 12, on the opposing substrate 2 side, in the same manner as explained in the opposing source construction, a gradation signal line 11 and a reference signal transfer pad 27 are placed are stacked on a black matrix layer 19 and an over-coat layer 20 that are formed on an insulating transparent substrate 10.

On the pixel substrate 1 side, a scanning line 6, a reference signal line 7 and a reference signal main line 9 are formed on the insulating transparent substrate 4, and on the top of these, a gate insulating film 12 and a protective film 17 are stacked. A hole section 28 is formed in the gate insulating film 12 and the protective film 17 corresponding to a portion on which the conduction section 26 is placed, a metal film of the reference signal main line 9 is exposed so that conduction is provided between the reference signal transfer pad 27 and the reference signal main line 9 through the conduction section 26. With respect to the conduction section 26, paste, such as carbon paste, silver paste and gold paste, is used.

Figure 13:
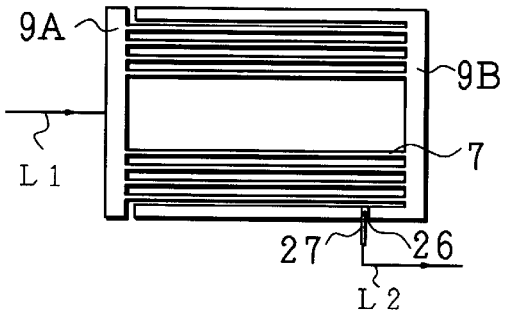
FIGS. 13(*a*) through 13(*g*) are plan views each of which exemplifies wiring in which the voltage applying line and voltage feedback line are connected to the reference signal circuit through the conductive section and the reference signal transfer pad.
Figure 13:
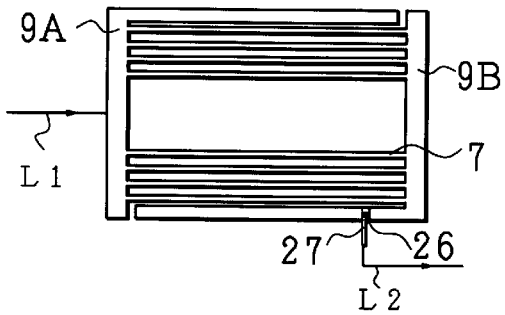
Figure 13:
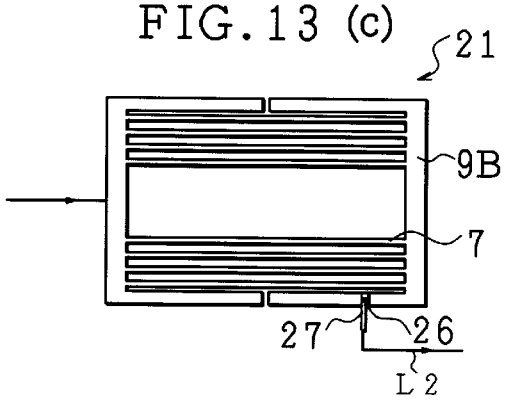
Figure 13:
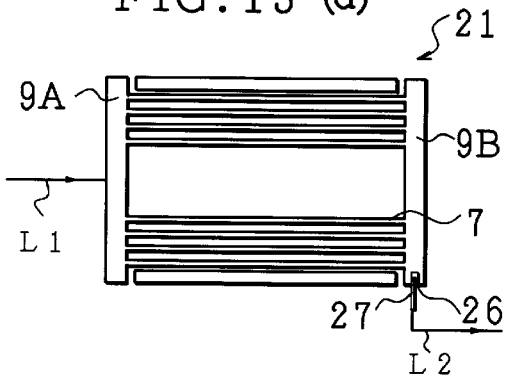
Figure 13:
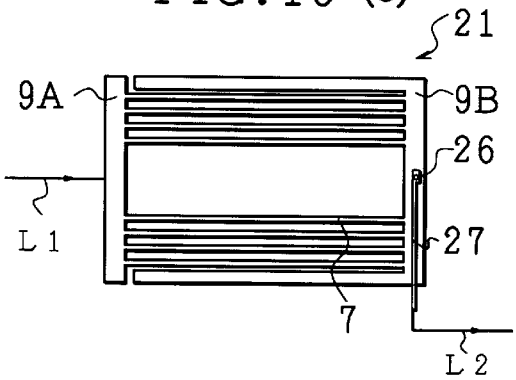
Figure 13:
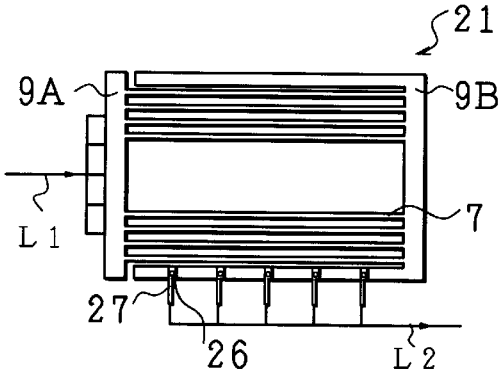
Figure 13:
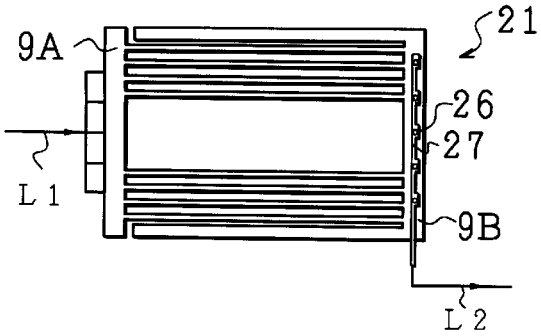

An explanation will be given of a specific structural example in which the conduction section 26, as well as the reference signal transfer pad 27, is connected to the reference signal circuit 21. FIGS. 13(*a*) through 13(*g*) are schematic views that shows simplified structural examples of the reference signal circuit 21. In the same manner as the structural examples shown in FIGS. 1(*a*) through 1(*d*), in the structural examples of the reference signal circuit 21 shown here, provision is made so that, when a minute voltage variation occurs in the reference signal circuit 21, the variation is detected, and a feed back is made to the voltage-applying circuit 22 so as to carry out a compensating operation.

As described above, in order to make the reference signal voltage uniform inside the display panel and provide a superior display by compensating the voltage of the reference signal, it is necessary to take the following point into consideration. As described above, the above-mentioned arrangement makes it possible to control the amount of feedback (amplification factor) to an optimal value so as to reduce shadowing by adjusting the resistivity of the resistor Rf. However, since the amplification factor is always maintained at a constant value with respect to the entire display panel, in order to carry out a uniform voltage compensation with respect to the entire display panel, the voltage detection portion needs to be set at a portion in which the impedance of the entire reference signal circuit 21 is accurately detected, that is, a portion which hardly susceptible to influences of unnecessary impedances from portions not related to display. Therefore, the separation of the reference signal main line 9 should be designed by taking the above-mentioned point into consideration.

Moreover, in the case of the above-mentioned structure, the place from which the voltage variation is detected is provided as a portion at which the reference signal transfer pad 27 and the reference signal circuit 21 is connected through the conduction section 26. Therefore, upon separating the reference signal main line 9 into the input main line 9A and the output main line 9B, it is necessary to install the conduction section 26 on the output main line 9B.

Moreover, since the reference signal main line 9 also functions as a light-shielding member, it is also necessary to keep the separation area SP between the input main line 9A and the output main line 9B as small as possible upon separating the input and output by means of patterning.

In an arrangement as shown in FIG. 13(*a*), the reference signal main line 9 is separated at an upper left portion and a lower left portion in the Figure so as to form the input main line 9A and the output main line 9B. In this arrangement, the reference signal voltage can be applied while eliminating the influences of impedances from the upper side portion and lower side portion of the reference signal main line 9.

In an arrangement as shown in FIG. 13(*b*), the reference signal main line 9 is separated at an upper right portion and a lower left portion in the Figure so as to form the input main line 9A and the output main line 9B. In this arrangement, the reference signal voltage can be detected while eliminating the influences of impedances from the upper side portion of the reference signal main line 9.

In an arrangement as shown in FIG. 13(*c*), the reference signal main line 9 is separated at an upper center portion and a lower center portion in the Figure so as to form the input main line 9A and the output main line 9B. In this arrangement, both of the detection of the reference signal voltage and the application of the reference signal voltage can be carried out under the same influences of impedances from the upper side portion and lower side portion of the reference signal main line 9.

In an arrangement as shown in FIG. 13(*d*), the reference signal main line 9 is separated at four portions, that is, upper left, lower left, upper right and lower left portions, in the Figure so as to form the input main line 9A and the output main line 9B. In this arrangement, the reference signal voltage can be detected and also can be applied while eliminating the influences of impedances from both of the upper side portion and lower side portion of the reference signal main line 9.

As described above, at the time of applying the reference signal voltage as well as detecting the reference signal voltage, the influences of impedances from the reference signal main line 9 can be minimized so that it is possible to detect even a minute voltage variation in the reference signal lines 7 inside the reference signal circuit 21 more accurately and consequently to compensate for the variation. Thus, it becomes possible to improve the display quality of the liquid crystal display.

Figure 14:
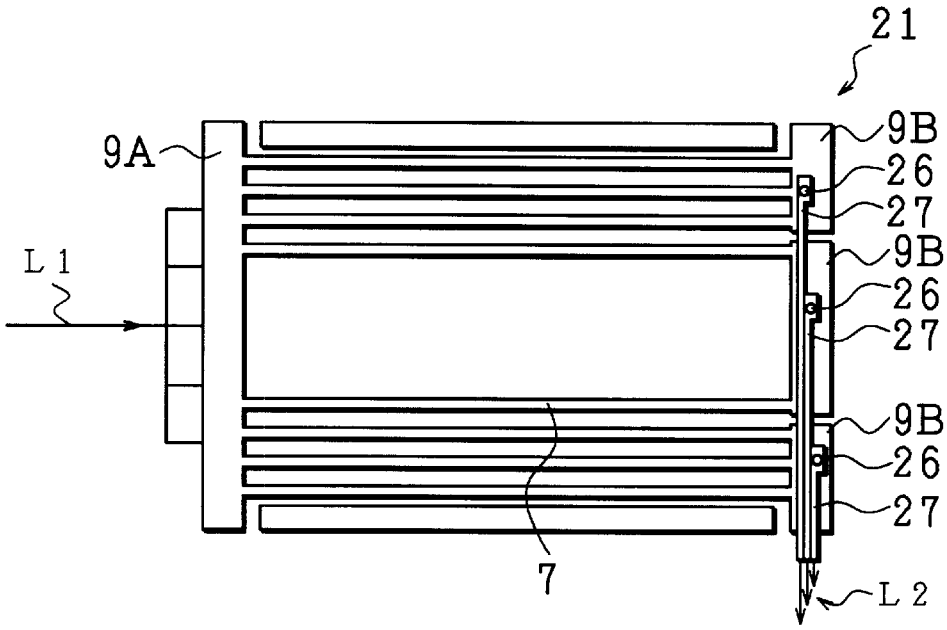
FIG. 14(*a*) is a plan view showing an arrangement in which an output main line is divided into three blocks.
Figure 14:
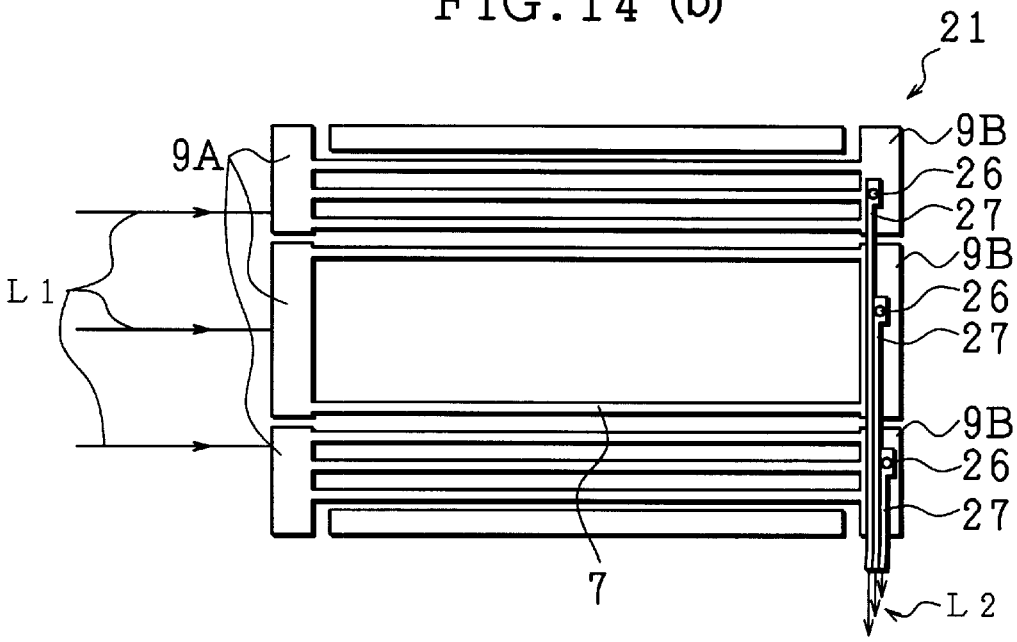

Next, referring to FIGS. 13(*e*) through 13(*g*) and FIGS. 14(*a*) and 14(*b*), the following description will discuss examples of the connection of the voltage application line L1 and the voltage feedback line L2 to the reference signal line 21.

FIG. 13(*e*) exemplifies a case in which the connection portion of the voltage feedback line L2 to the reference signal circuit 21, that is, the location of the conductive section 26, is set in the center of the right side portion of the reference signal main line 9 so that the reference signal transfer pad 27 is formed from the conductive section 26 to the source control substrate, not shown. In this manner, the location of the conductive section 26 may be set at any position on the output main line 9B, and the location may be freely changed depending on mutual positional relationships with the other components in the liquid crystal display.

Moreover, the connection portions of the voltage application line L1 and the voltage feedback line L2 to the reference signal circuit 21 are not limited to one portion, and they may be connected at a plurality of portions. FIGS. 13(*f*)

and 13(*g*) respectively show structural examples in which a plurality of connection portions to the reference signal circuit 21 are provided for the voltage application line L1 and the voltage feedback line L2. This arrangement in which a plurality of connection portions to the reference signal circuit 21 are provided for the voltage application line L1 and the voltage feedback line L2 makes it possible to detect a minute voltage variation in the reference signal circuit 21 more accurately. Consequently, it becomes possible to further improve the display quality.

In order to detect the voltage variation with more precision, an arrangement as shown in FIG. 14(*a*) may be proposed. In this arrangement, the output main line 9B is separated into three blocks, and the voltage variation is detected for each block. With this arrangement, it is possible to detect and compensate for a minute voltage variation in the reference signal circuit 21 more accurately. Here, the number in which the output main line 9B is separated is not intended to be limited by three, two or not less than three may of course be adopted.

Moreover, as illustrated in FIG. 14(*b*), not only the output main line 9B, but also the input main line 9A, may be separated into a plurality of blocks; thus, it becomes possible to detect and compensate for a minute voltage variation in the reference signal circuit 21 more accurately.

As described above, in the liquid crystal display in accordance with the present embodiment, the reference signal main line 9 is separated to the input main line 9A and the output main line 9B in an insulating state with each other, and the voltage application line L1 for applying a voltage from the voltage-applying circuit 22 and the voltage feedback line L2 for feeding a voltage back to the voltage-applying circuit 22 are respectively connected to the input main line 9A and the output main line 9B. Therefore, the voltage applied to the input main line 9A is outputted from the output main line 9B after passing through the respective reference signal lines 7. Consequently, the voltage-applying circuit 22 is allowed to accurately detect minute voltage variations caused by the respective reference signal lines 7 inside the reference signal circuit 21, and can carry out a proper voltage-compensating process by adjusting the applying voltage based upon the detected voltage variations. With this arrangement, without a reduction in the aperture ratio caused by the widened line width of the reference signal line 7 and the widened distance between the line gaps, it is possible to prevent shadowing caused by an insufficient supply of charge due to a delay in the reference signal, and consequently to provide a liquid crystal display that is superior in display quality.

Moreover, in the above-mentioned arrangement, the liquid crystal display has the so-called opposing source construction so that the scanning lines 6 and the gradation signal lines 11 are formed on independently different substrates; therefore, since the scanning lines 6 and the gradation signal lines 11 are not made to intersect each other on the same substrate, it is possible to reduce the rate of occurrence of line defects. Consequently, it becomes possible to improve the yield and also to reduce the production costs.

Additionally, in the present embodiment, the explanation has been given of constructions on the assumption that a liquid crystal display of the light-transmission type is adopted; however, the same construction is also applied to a liquid crystal display of the reflection type with the same functions and effects.

As described above, the liquid crystal display of the present invention, which is provided with: a pixel substrate; an opposing substrate aligned face to face with the pixel substrate with a gap in between; a plurality of pixel electrodes formed on the pixel substrate in a matrix format; opposing electrodes formed on the opposing substrate in association with the pixel electrodes; a plurality of scanning lines and a plurality of reference signal lines that are placed in parallel with each other in each of the border areas between the pixel electrodes on the pixel substrate; a gradation signal line that is placed in a direction orthogonal to the scanning lines on the opposing substrate and that is electrically connected to the opposing electrodes; and a switching element of a three-terminal type having respective terminals electrically connected to the scanning line, the reference signal line and the pixel electrode on the pixel substrate, is characterized by further comprising: a reference signal main line that is placed so as to electrically connect the reference signal lines with each other on the periphery of the area in which the reference signal lines are placed; and a voltage applying circuit for applying a reference signal voltage to the reference signal circuit constituted by the reference signal lines and the reference signal main line, and for controlling the applying voltage in response to voltage variations in the reference signal circuit. In this arrangement, the reference signal main line includes an input main line and an output main line, the input main line and the output main line being electrically connected to each other through the reference signal line, with their portions other than the connected portions through the reference signal line being in an electrically insulated state or in a high impedance state, and an input section for applying a voltage from the voltage applying circuit is placed in the input main line and an output section for feeding a voltage back to the voltage applying circuit is placed in the output main line.

In this arrangement, a voltage applied to the reference signal circuit through the input section is outputted from the output section after passing through the reference signal line. Consequently, the voltage applying circuit is allowed to accurately detect minute voltage variations caused by the respective reference signal lines inside the reference signal circuit, and can carry out a proper voltage-compensating process by adjusting the applying voltage based upon the detected voltage variations. With this arrangement, without a reduction in the aperture ratio caused by the widened line width of the reference signal line and the widened distance between the line gaps, it is possible to prevent shadowing caused by an insufficient supply of charge due to a delay in the reference signal, and consequently to provide a liquid crystal display that is superior in display quality.

Moreover, in the above-mentioned arrangement, the liquid crystal display has the so-called opposing source construction so that the scanning lines and the gradation signal lines are not made to intersect each other on the same substrate; thus, it is possible to reduce the rate of occurrence of line defects. Consequently, it becomes possible to improve the yield and also to reduce the production costs.

In the liquid crystal display of the present invention, it is preferable to provide an arrangement in which: a conductive portion made from a conductive material, which extends from the input section or the output section placed on the pixel substrate to reach the opposing substrate, is further placed in the area sandwiched by the pixel substrate and the opposing substrate, and an electrical connection between the input section and the wire from the voltage-applying circuit or an electrical connection between the output section and the wire from the voltage-applying circuit is made through the conductive portion.

In the case when the input section and the output section are placed in a separate manner on the pixel substrate, the respective sections are placed at positions apart from each other. For example, assuming that the voltage-applying circuit is placed on the gate control substrate on which a driver for driving a scanning signal is placed, and that the input section is placed at a position close to the gate control substrate, the output section needs to be placed at a position farthest from the gate control substrate. In this case, the wire extending from the output section to reach the voltage-applying circuit is made to once pass through the wiring substrate placed at a position opposite to the gate control substrate with respect to the pixel substrate, and to reach the gate control substrate from the wiring substrate through a source control substrate on which a driver for driving a gradation signal.

In contrast, in the above-mentioned arrangement, the input section or the output section is electrically connected to the wire that reaches the voltage-applying circuit through the conductive section; therefore, for example, in the above-mentioned structural example, the voltage from the output section is fed back to the voltage-applying circuit on the gate control substrate from the wire on the opposing substrate through the source control substrate via the conductive section. Therefore, since no wiring substrate as described above is required, it is possible to simplify the assembled structure of the liquid crystal display, to reduce the size of the apparatus as a whole, and to cut the material costs and production costs.

Moreover, in the liquid crystal display of the present invention, it is preferable to install the input section and/or output section at a plurality of positions. This arrangement allows the voltage-applying circuit to compensate for minute voltage variations occurring in the reference signal lines more accurately without having any influences from impedances of the input main line and the output main line. Thus, it becomes possible to provide a liquid crystal display having superior display quality.

Furthermore, in the liquid crystal display of the present invention, it is preferable to allow the input main line and the output main line to have impedances lower than that of the reference signal lines. This arrangement allows the voltage-applying circuit to compensate for minute voltage variations occurring in the reference signal lines more accurately without having any influences from impedances of the input main line and the output main line. Thus, it becomes possible to provide a liquid crystal display with superior display quality.

In the liquid crystal display of the present invention, it is preferable to design the input main line and output main line so as to have a line width thicker than the above-mentioned reference signal line. This arrangement makes it possible to easily achieve a construction having a low impedance.

Moreover, in the liquid crystal display of the present invention, it is preferable to design the input main line and/or output main line so as to be separated into a plurality of blocks. This arrangement allows voltage variations to be detected for each block, thereby allowing the voltage-applying circuit to compensate for minute voltage variations occurring in the reference signal lines more accurately. Thus, it becomes possible to provide a liquid crystal display having superior display quality.

Furthermore, in the liquid crystal display of the present invention, it is preferable to design the gradation signal line to be formed to reach positions corresponding to the upper side portion and lower side portion of the reference signal main line. With this arrangement, it becomes possible to form capacitances between the gradation signal line and the upper side portion as well as the lower side portion of the reference signal main line, and consequently to provide high impedances at the upper side portion and the lower side portion of the reference signal main line. Since it is not necessary to form the reference signal main line in a separate manner into the input main line and the output main line, the liquid crystal display device can be simplified and the production costs can be reduced.

Here, "the upper side portion and the lower side portion" refer to two opposing sides among four sides on which the reference signal main line is formed, and these sides are located between the input main line and the output main line.

Moreover, in the liquid crystal display of the present invention, it is preferable to design the voltage-applying circuit to have an adjusting means for adjusting the applying voltage. This arrangement makes it possible to easily adjust the amplification factor of the voltage-applying circuit so as to provide a superior display while preventing shadowing.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A liquid crystal display of the present invention, comprising:

a pixel substrate;

an opposing substrate aligned face to face with the pixel substrate with a gap in between;

a liquid crystal layer that is sandwiched in the gap between the pixel substrate and the opposing substrate;

a plurality of pixel electrodes formed on the pixel substrate in a matrix format;

opposing electrodes formed on the opposing substrate in association with the pixel electrodes;

a plurality of scanning lines and a plurality of reference signal lines that are placed in parallel with each other in each of the border areas between the pixel electrodes on the pixel substrate;

a gradation signal line that is placed in a direction orthogonal to the scanning lines on the opposing substrate and that is electrically connected to the opposing electrodes; and a switching element of a three-terminal type having respective terminals electrically connected to the scanning line, the reference signal line and the pixel electrode on the pixel substrate, is characterized by further comprising:

a reference signal main line that is placed so as to electrically connect the reference signal lines with each other on the periphery of the area in which the reference signal lines are placed; and a voltage applying circuit for applying a reference signal voltage to a reference signal circuit constituted by the reference signal lines and the reference signal main line, and for controlling the applying voltage in response to voltage variations in the reference signal circuit, wherein: the reference signal main line includes an input main line and an output main line, the input main line and the output main line being electrically connected to each other through the reference signal line, with their portions other than the connected portions through the reference signal line being in an electrically insulated state or in a high impedance state, and an input section for applying a voltage from the voltage applying circuit is placed in the input main line and an output section for feeding a voltage back to the voltage applying circuit is placed in the output main line.

2. The liquid crystal display as defined in claim 1, wherein: a conductive portion made from a conductive material, which extends from the input section or the output section placed on the pixel substrate to reach the opposing substrate, is further placed in an area sandwiched by the pixel substrate and the opposing substrate, and an electrical connection between the input section and the wire from the voltage-applying circuit or an electrical connection between the output section and the wire from the voltage-applying circuit is made through the conductive portion.

3. The liquid crystal display as defined in claim 1, wherein the input section and/or output section are installed at a plurality of positions.

4. The liquid crystal display as defined in claim 1, wherein the input main line and the output main line are allowed to have impedances lower than that of the reference signal lines.

5. The liquid crystal display as defined in claim 4, wherein the input main line and output main line have a line width thicker than the reference signal line.

6. The liquid crystal display as defined in claim 1, the input main line and/or output main line are separated into a plurality of blocks.

7. The liquid crystal display as defined in claim 1, wherein the gradation signal line is formed to reach positions corresponding to an upper side portion and a lower side portion of the reference signal main line.

8. The liquid crystal display as defined in claim 1, wherein the voltage-applying circuit is provided with an adjusting means for adjusting the applying voltage.

* * * * *